US005288075A

United States Patent [19]

Kelley

[11] Patent Number: 5,288,075

[45] Date of Patent: Feb. 22, 1994

[54] IMAGE RECOGNITION GAME APPARATUS

[75] Inventor: Glen M. Kelley, Gaithersburg, Md.

[73] Assignee: The Face To Face Game Company, Beverly Hills, Calif.

[21] Appl. No.: 823,627

[22] Filed: Jan. 21, 1992

Related U.S. Application Data

[63] Continuation-in-part of Ser. No. 499,993, Mar. 27, 1990, abandoned, which is a continuation of Ser. No. 650,564, Feb. 4, 1991, abandoned.

[51] Int. Cl.[5] ..... A63F 3/00

[52] U.S. Cl. ..... 273/243; 273/289; 434/348

[58] Field of Search ..... 273/237, 243, 249, 273, 273/274, 281, 282, 284, 155, 157, 289; 434/333, 348, 405; 40/492

[56] References Cited

U.S. PATENT DOCUMENTS

| | | | |
|---|---|---|---|
| 3,097,435 | 7/1963 | Goldschmidt | 434/348 |
| 3,110,499 | 11/1963 | Boeskool | 434/348 X |
| 3,224,112 | 12/1965 | Hanson | 434/348 |
| 3,347,549 | 10/1967 | Jackson | 273/273 |
| 3,462,154 | 8/1969 | Giraud et al. | 273/273 |
| 3,939,578 | 2/1976 | Coffey | 273/243 X |
| 4,089,527 | 5/1978 | Roth | 273/273 X |
| 4,566,698 | 1/1986 | Sneden | 273/249 |
| 4,731,027 | 3/1988 | Phinney | 434/348 |
| 4,829,431 | 5/1989 | Ott et al. | 273/273 |
| 4,829,686 | 5/1989 | Endicott | 40/492 |
| 4,848,771 | 7/1989 | Richardson | 273/237 |
| 5,112,057 | 5/1992 | Popovic | 273/243 |

*Primary Examiner*—William Stoll

*Attorney, Agent, or Firm*—Banner, Birch, McKie & Beckett

[57] ABSTRACT

The game includes a gameboard, game pieces, image or face cards and a revealing device. The device includes a plurality of shutters, each slidable between open and closed positions. With a face card inserted in the device and the shutters closed, the face is covered, since each shutter covers a different portion of the face, and all portions are thereby covered. As the shutters are separately opened, the face is incrementally revealed. The opening of the shutters is determined by the movement of the game pieces on the gameboard, which can be determined by the roll of a pair of dice or by other random apparatus. Points are awarded to the player who first correctly identifies the face on the card as the shutters are slid to their open positions, and the face thereby incrementally revealed.

19 Claims, 21 Drawing Sheets

The Image Recognition Game
FACE IT
FACE IT
FACE IT

FIG. 45

261 262 263

| Card # | Name | Occupation |
|---|---|---|
| 1 | Johnny Carson | Host - Tonight Show |
| 2 | George Bush | 41st President of the U.S. |
| 3 | Ralph Nader | Economist |
| 4 | Hugh Heffner | Entrepreneur, Playboy |
| 5 | Tom Cruise | Actor |
| 6 | Jane Fonda | Actress |
| 7 | Barbara Walters | News Anchor |
| 8 | Barbara Bush | First Lady |
| 9 | Peter Gabriel | Rock Star, Musician |
| 10 | Mel Gibson | Actor |
| 11 | Jane Seymour | Actress |
| 12 | Billy Idol | Rock Star |
| 13 | Willie Shoemaker | Jockey |
| 14 | Kevin Costner | Actor |
| 15 | Clint Eastwood | Actor |
| 16 | Michael Jackson | Entertainer, Rock Star |
| 17 | Lucille Ball | Actress |
| 18 | Eddie Murphy | Actor |
| 19 | John Travolta | Actor |
| 20 | Nick Nolte | Actor |
| 21 | Don Henley | Musician, Rock Star |
| 22 | Molly Ringwald | Actress |
| 23 | Barbara Mandrel | Entertainer |
| 24 | Geraldo Rivera | Reporter, Talk Show Host |
| 25 | Muhammed Ali | Former Heavy Weight Boxing Champion |
| 26 | Ronald Reagan | 40th President of the U.S. |
| 27 | Andy Griffith | Actor |
| 28 | James Spader | Actor |
| 29 | Warren Beatty | Actor |
| 30 | Walter Matthau | Actor |
| 31 | Dr. Ruth Westheimer | Health Expert |
| 32 | Lyle Alzado | Former Professional Football Player |

IMAGE RECOGNITION GAME APPARATUS

CROSS-REFERENCE TO RELATED APPLICATION

This is a continuation-in-part of copending application Ser. No. 07/499,993 filed Mar. 27, 1990, and a continuation of Ser. No. 07/650,564 filed Feb. 4, 1991, now abandoned and whose entire contents are hereby incorporated by reference.

BACKGROUND OF THE INVENTION

The present invention relates to games and particularly board games concerned with recognizing and identifying faces and/or other images. The invention is further concerned with game methods for learning and remembering new images.

We are continually being confronted with new sights—faces of people in the news, people in sports or entertainment, new products on the market and even new buildings. After seeing numerous images we will forget a good deal of and about what we see. We can retain more than just an image that we perceive, as we can also retain information about the image. Often, however, we remember only the image or its description (or title). Our ability to identify images or faces that we have previously seen and to match faces we may never have seen before, with names with which we are quite familiar, often needs to be challenged and improved. We have all heard of the noteworthy Paul Revere, but how many of us could pick his face out of a crowd? Conversely, there are many hundreds of faces which we recognize, but cannot identify immediately, if at all. This basic idea can also be used with other images, both animate or inanimate.

The popular "Trivial Pursuit" game in a sense is directed towards furthering one's foundation of factual information. That game is limited though in the variety of people who can enjoy playing it.

Other memorization, identification and/or educational game apparatuses or information systems are known. Examples thereof are shown in U.S. Pat. Nos. 3,097,435, 3,110,499, 3,224,112, 3,347,549, 3,462,154, 3,939,578, 4,089,527, 4,829,431, 4,829,686 and 4,848,771. (These and any other patents or other publications mentioned anywhere in this disclosure are hereby incorporated by reference in their entireties.) Many betting and wagering board games are found in the prior art. They have been defined in part as games in which "each participant indicates a selected number of chance result indicia (i.e., his selected bets or wages) and the number of contest elements he wishes to risk (i.e., the amount of his bets or wages).

SUMMARY OF THE INVENTION

A game of this invention, according to one aspect thereof, has the four below-listed components.

A. The images. There are cards with various faces or images on them, and the first object of the game is to be able to identify these various images.

B. Revealing device or method used to disguise parts of a card's image. A device for revealing part of a card's image is used to increase the difficulty of identifying a given image.

C. The element of time. By introducing a timer or timing method into the game, one is challenged to quickly call upon information, creating an exciting atmosphere.

D. Scorekeeping. By using points to identify the leader, the game becomes competitive, and by introducing the ability to bet, another dimension to the game is created.

Thus, elements of the present game apparatus are the game cards, the method of play and the revealing method of play. The cards have faces or images on them from categories such as entertainers, historical figures, politicians, sports stars, artists, writers, celebrities, businessmen or any public person. Other categories include animals, birds, fish, plants, geological matter, scientific matter, art, architecture, cartoon characters, automobiles, planes and boats. The object of the game is to identify these images or faces on cards, video screens or television screens, against a timing means and within the constraints of the rules of the game. The revealing method is introduced to hide portions of the face or image in some manner so that the identification of the face or image is more challenging. Methods of revealing include devices which cover the face or image, and portions can be removed or moved to reveal part of an image at a time, devices which hold portions of an image or face which can be collected to form the whole, and in a video version shows only the portion of the card or image at a time, or shows the entire image, but has portions covered up, or shows the whole face or image, but has them jumbled.

The number of face images in each of the previously-mentioned categories is almost limitless. Since images and recognizable faces (humans, birds, animals, planes, cartoons, shapes of states, countries, and so forth) are common, everyone including children can play, enjoy and learn from this information. For example, this game can be used with animals for younger children in school or at home as an enjoyable way to learn facts and important recognizable information. For college and high school students, names can be associated with famous writers, artists, works of art, architecture, or even in the case of chemists, the symbol for citric acid could be an "easy point." For car or plane buffs, this game can test their abilities to recognize cars not found in this country or planes that went out of production years ago. Historians, professors and serious collectors can request versions of the game that would test their abilities to recognize even more difficult subjects, such as ancient artifacts, coins, stamps or rocks or other geological matter. Boy Scouts or other civic groups can use the game to recognize types of knots, poisonous plants, animals, animal tracks and the like. Sports fans can use it to learn not only the statistics and the names of athletes but their faces as well. In a way this game is like a visual encyclopedia, but with a competitive element to it. Because all of this knowledge can be gained while having fun, children may decide to play this game instead of spending their time on less educational activities.

A video version of this game can be useful in schools so that each student in the classroom can watch his classmates try to identify a face or other image and in the process learn that face or image themselves. The image can be partially covered and the uncovered portions continuously or incrementally revealed, or the portions of the image in a jumbled order and gradually or incrementally unjumbled, or the image can be clouded over and gradually or incrementally unclouded. This game thus had great educational value, and schools can easily incorporate it in their curriculum.

Other objects and advantages of the present invention will become more apparent to those persons having ordinary skill in the art to which the present invention pertains from the foregoing description taken in conjunction with the accompanying drawings.

BRIEF DESCRIPTION OF THE DRAWINGS

FIG. 45 is a top view of a masterlist booklet of the apparatus of FIG. 35, shown in an open position.

DETAILED DESCRIPTION OF PREFERRED EMBODIMENTS OF THE INVENTION

Figure 1:
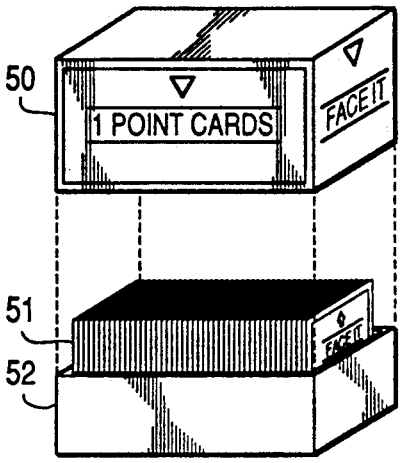
FIG. 1 is a perspective view of a one-point card box of the present invention.
Figure 2:
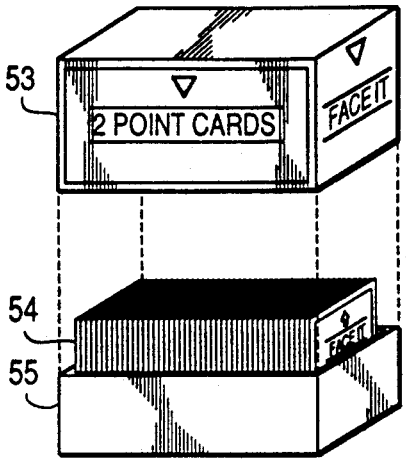
FIG. 2 is a perspective view of a two-point card box.
Figure 3:
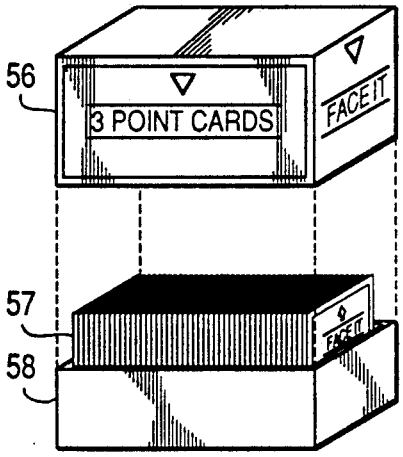
FIG. 3 is a perspective view of a three-point card box.
Figure 4:
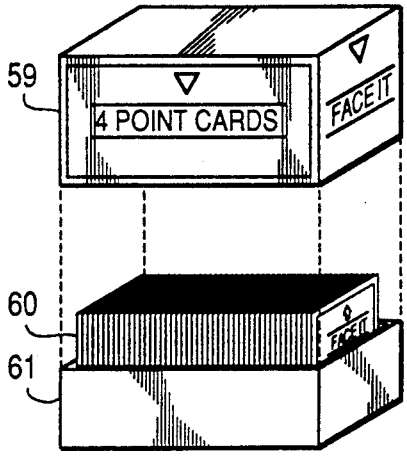
FIG. 4 is a perspective view of a four-point card box.
Figure 21A:
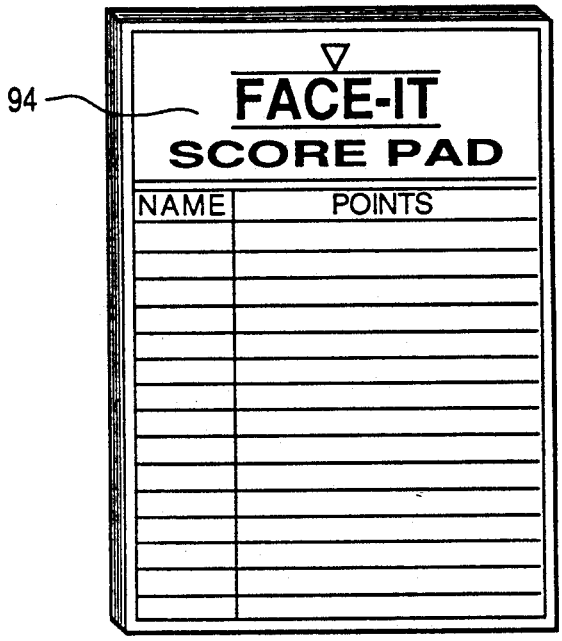
FIG. 21A is a view of a score pad for scorekeeping.
Figure 21B:
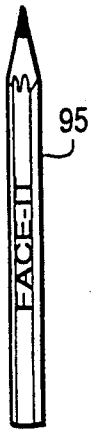
FIG. 21B is a view of a pencil for scorekeeping.

An object of one preferred version of the present invention is to be the first player to score a predetermined number of points, such as one hundred points. Two or more individuals or teams can play. The equipment of the game includes: four gamecard boxes comprising a top 50 and a bottom 52, one each of gray as shown in FIG. 1, burgundy comprising a box top 53 and a bottom 55 as shown in FIG. 2, blue having a top 56 and a bottom 58 as seen in FIG. 3 and gold having a top 59 and a bottom 61 as shown in FIG. 4; five hundred gray gamecards 51 (see also FIG. 8); five hundred burgundy gamecards 54 (see also FIG. 9); five hundred blue gamecards 57 (see also FIG. 10); five hundred gold gamecards 60 (see also FIG. 11); one betting cards box having a top 62 and a bottom 64 (see FIG. 5); one hundred one-point betting cards 63 (see also FIGS. 12 and 13); one hundred five-point betting cards 63 (see also FIGS. 12 and 13); one hundred ten-point betting cards 63 (see also FIGS. 12 and 13); one hundred twenty-point betting cards 63 (see also FIGS. 12 and 13); one die having one gray side 80, one burgundy side 81, one blue side 82, one gold side 77, and two zeros 78 and 79 (see FIGS. 14 and 15), one master list booklet with the names 123, brief description or title of image 124 and reference numbers 122 (see FIG. 28) which are on the cards faces 70 (see FIG. 7); one score pad with pencil 95 and grid paper 94 for scorekeeping as shown in FIGS 21A and 21B; one fifteen second timer with a second hand 107, seconds markers 153, and a plastic housing containing an audio buzzer 108 and an on/off button 106 to start and stop timing (see FIG. 24); and eight revealing devices (see FIGS. 25 and 26). Alternate revealing devices are illustrated in FIGS. 19, 22, 27, 31, 32 and 33.

Figure 6:
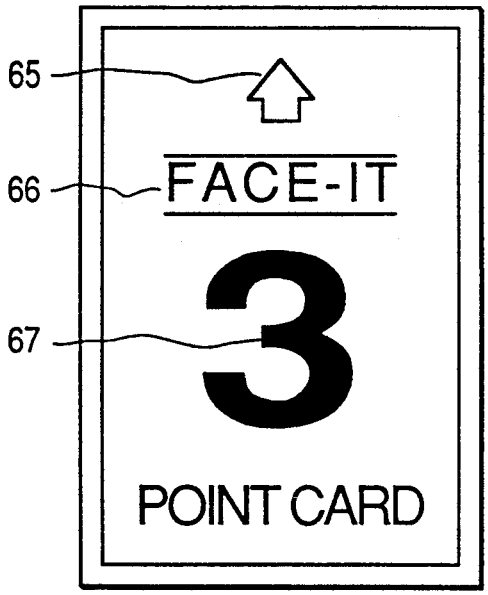
FIG. 6 is a rear view of a playing card of this invention.
Figure 14:
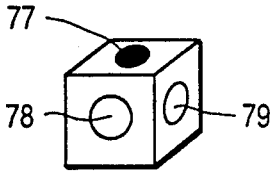
FIG. 14 is a view of a die of this invention.
Figure 15:
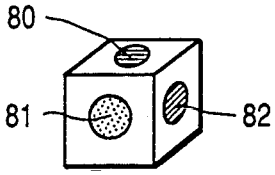
FIG. 15 is a perspective view of three hidden sides of the die of FIG. 14.
Figure 20:
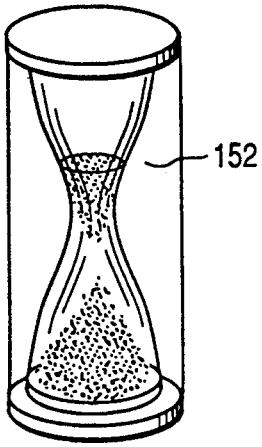
FIG. 20 is a view of an hourglass for timekeeping.
Figure 24:
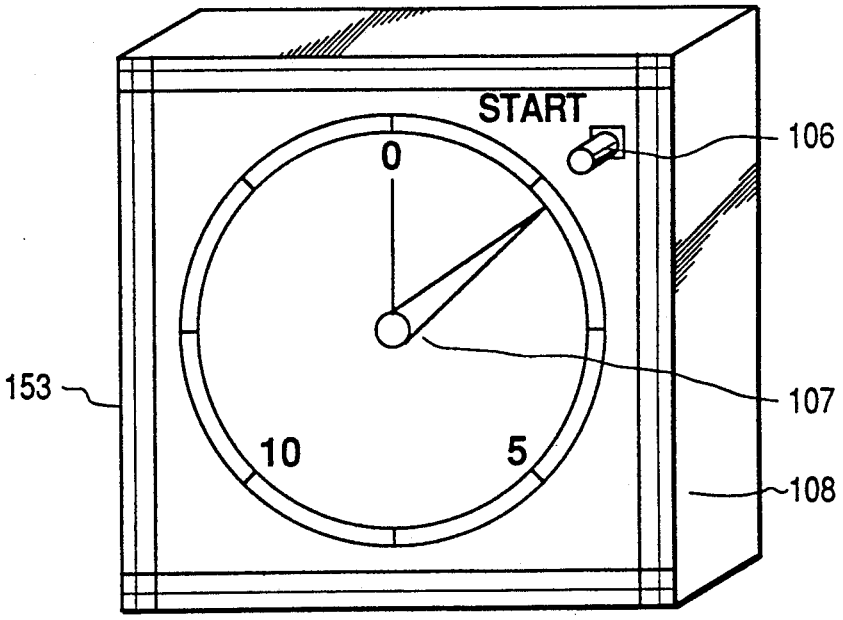
FIG. 24 is a view of a timer with an audio buzzer.

Each player begins by rolling the dice of FIGS. 14 and 15, and play continues in a clockwise direction. Each player also begins by choosing any four gamecards as shown in FIGS. 8, 9, 10 and 11 and any combination thereof is permitted. The color of the card corresponds to that card's identification difficulty level as described above. When each player has chosen his cards as pictured in FIGS. 8, 9, 10 and 11, the cards are placed face down without being seen by anyone, including the player who has chosen them. Each player then takes his turn in order, being timed against the clock as seen in FIG. 24 or other timer, such as an hour glass 152 as seen in FIG. 20, trying to identify his four cards within the allotted time. Points are awarded for each correct identification corresponding to the point value on that card (in FIGS. 8, 9, 10, 11, numbers 71, 72, 73 and 74, respectively), shown on the rear of the card, as shown in FIG. 6 by reference numeral 67. These points are accumulated and may be used in later betting rounds. Each player finishes the first round, and the player with the most points at the end of the first round has first "seed" in the next round.

Figure 25:
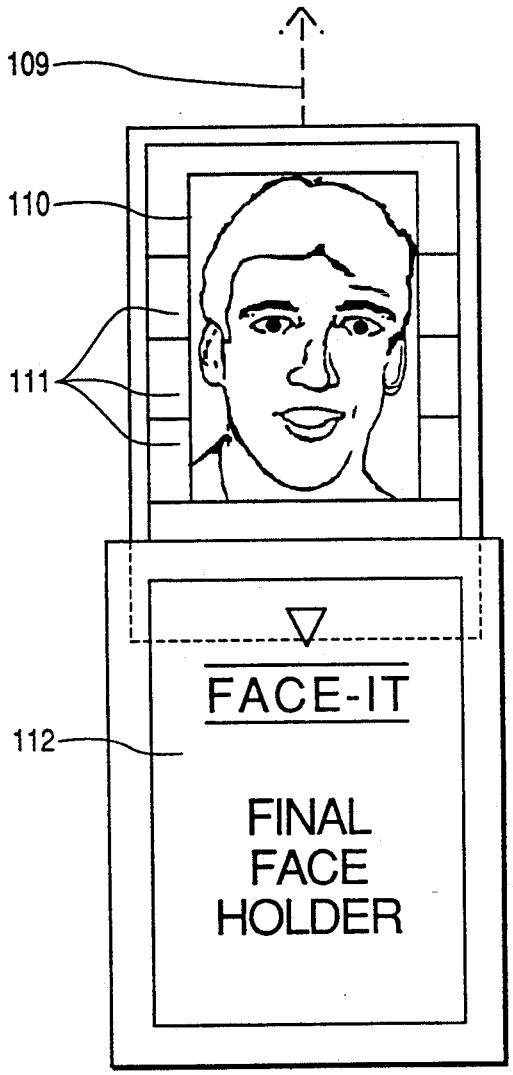
FIG. 25 is a front view of a revealing device.
Figure 26:
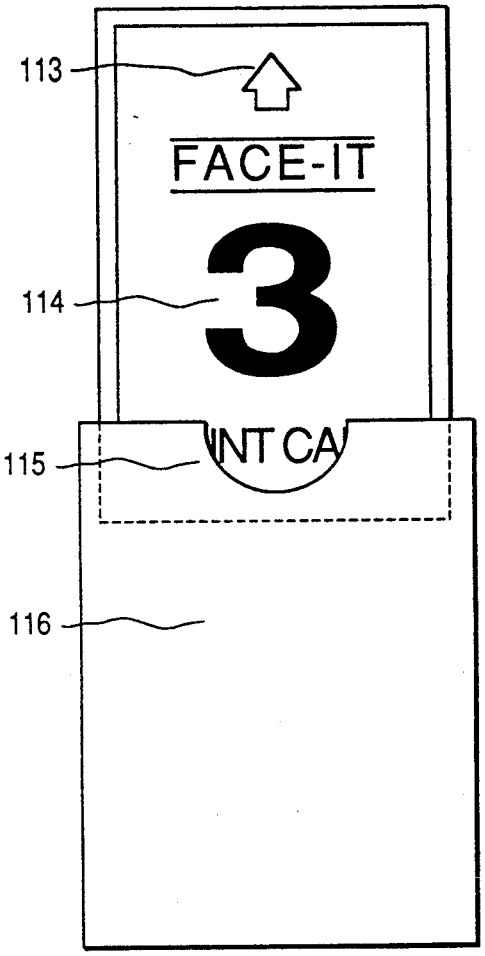
FIG. 26 is a rear view of the revealing device of FIG. 25.
Figure 27:
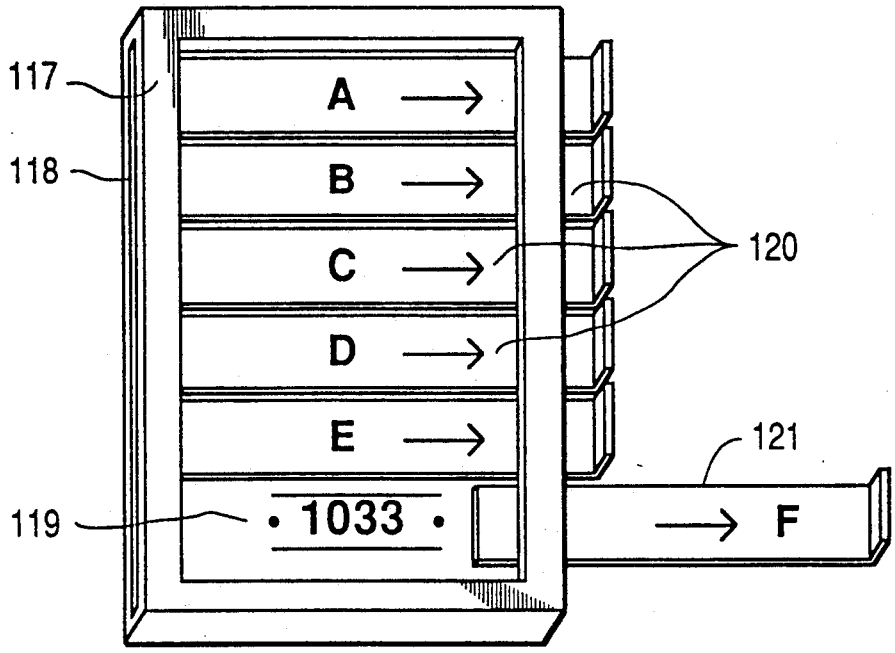
FIG. 27 is a view of an alternate revealing device.

The next round of play begins with each player selecting a card (FIGS. 8, 9, 10 and 11) and placing it, without it being seen by anyone else, into a revealing device (FIGS. 25 and 26). Alternate devices are shown in FIGS. 19, 22, 27, 31, 32 and 33. It is important that each player know the correct name or description for his card. If it is not known, he must look it up in the master list booklet of FIG. 28 before placing it into his revealing device. The player who goes first in this round then chooses any other player's hidden card; see reference numeral 110 in FIG. 25, numeral 114 in FIG. 26, numeral 119 in FIG. 27, numeral 91 in FIG. 19, numerals 96 or 101 in FIG. 22, numeral 142 in FIG. 31 and numeral 145 in FIGS. 32 and 33 for examples of hidden cards shown in revealing devices. Points can be wagered up to that player's winning. The player bets on whether or not he can correctly identify the hidden card (see reference numeral 110 in FIG. 25, for example) with only a discrete portion of the card being revealed. The player decides on a wager and then asks the player whose hidden card he is trying to guess to lower, or uncover, any portion of the face or image which he desires, one increment only, for example, see reference numeral 145 in FIGS. 32 and 33 or numeral 142 in FIG. 31. The player then tries to identify the face or image on the card and if successful he earns the points indicated on that identified card, see reference numeral 114 in FIG. 26 or numeral 71 in FIG. 8, plus double what he bet (awarded as betting cards, see FIGS. 12 and 13), and play continues to the player with the second most points from the first round. However, if the player is incorrect, play passes to the next player and he or she can continue with that same hidden face which now has a portion exposed, or he can choose another player's hidden card. Play continues, alternating from round to round, until the first player reaches one hundred points or any other predetermined point amount.

A. One Embodiment In Game Instruction Format (1) Object of the Game

To be the first player to score one hundred points.

(2) Players

Two or more players, or teams of players.

(3) Equipment

Figure 5:
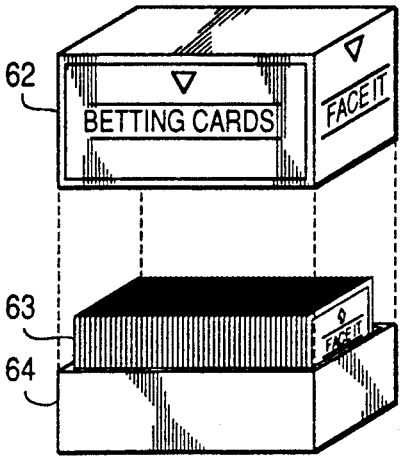
FIG. 5 is a perspective view of a betting cards box of the present invention.
Figure 28:
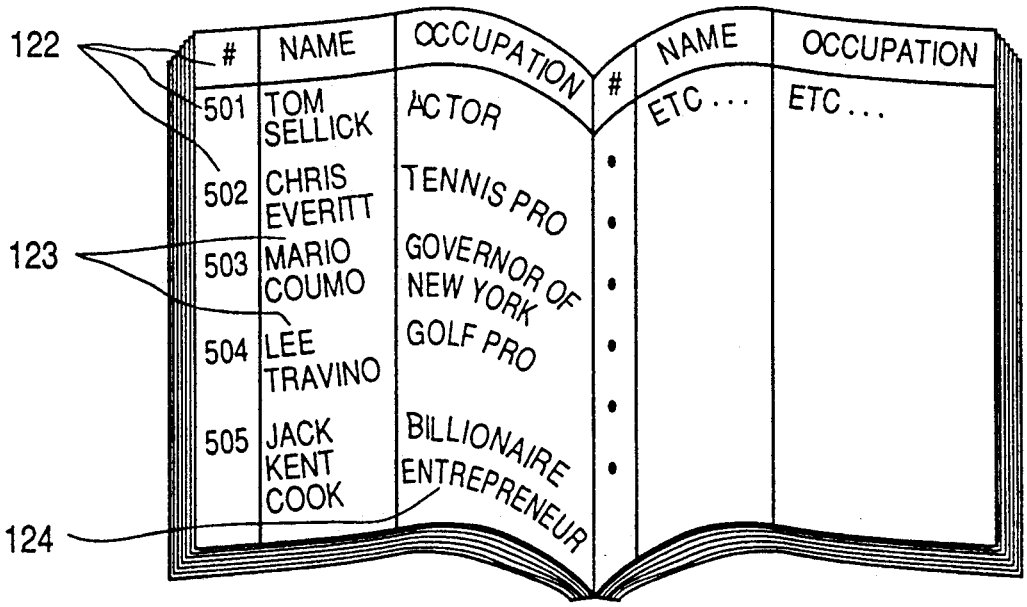
FIG. 28 shows a master list booklet, with the names of the images numbered and coded for referencing and verification.

Four "Face-It" card boxes (one each of gray as shown in FIG. 1 at 50 and 52, burgundy as shown in FIG. 2 at 53 and 55, blue as shown in FIG. 3 at 56 and 58 and gold as shown in FIG. 4 at 59 and 61), five hundred gray Face-It cards as shown in FIG. 1 at 51, five hundred burgundy Face-It cards as shown in FIG. 2 at 54, five hundred blue Face-It cards as shown in FIG. 3 at 57, and five hundred gold Face-It cards as shown in FIG. 4 at 60, one betting cards box as shown in FIG. 5 at 62 and 64, one hundred one-point betting cards as shown in FIG. 5 at 63 (gold), one hundred five-point betting cards as shown in FIG. 5 at 63 (gold), one hundred ten-point betting cards as shown in FIG. 5 at 63 (gold), and one hundred twenty-point betting cards as shown in FIG. 5 at 63 (gold), one "Face-Off" die as shown in FIGS. 14 and 15, one master list booklet illustrated in FIG. 28, one score pad shown in FIG. 21, one twenty-second timer shown in FIG. 24, and eight plastic "Final Face" holders depicted in FIGS. 25 and 26. Alternate revealing devices are shown in FIGS. 19, 22, 27, 31, 31 and 33.

(4) Getting Ready to "Face-It"

Each player begins by rolling the Face-Off die of FIGS. 14 and 15. The person who rolls the first blue 82 of FIG. 15 goes first, and play continues in a clockwise direction. The Face-Off die has one face 82 which is blue, one gray 80, one gold 77 and one burgundy 81. The other two sides have zeros on them 78, 79 representing an option (see FIGS. 14 and 15).

(5) Setting up the Play.

Each player begins by selecting any four Face-It cards (FIGS. 8, 9, 10 and 11) from any of the four colored Face-It boxes. The color represents a level of difficulty for that card.

Figure 8:
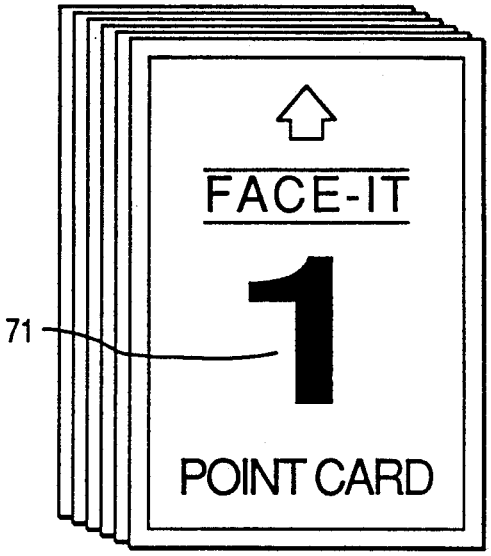
FIG. 8 is a view of a stack of one-point cards.
Figure 9:
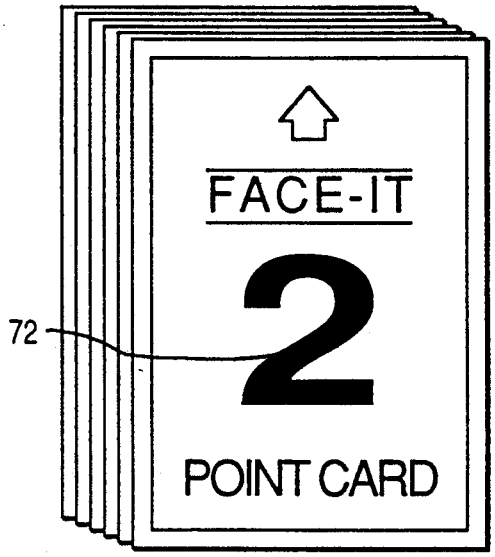
FIG. 9 is a view of a stack of two-point cards.
Figure 10:
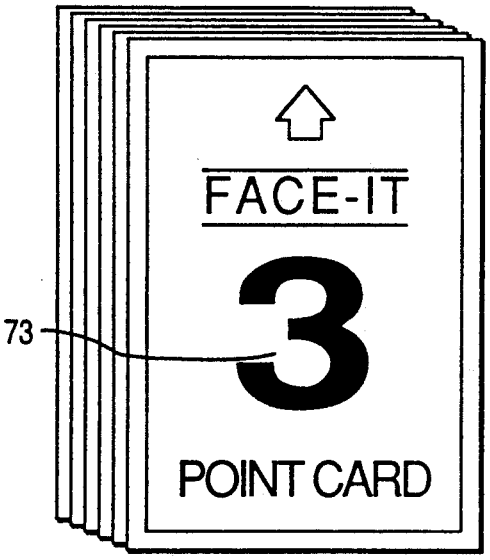
FIG. 10 is a view of a stack of three-point cards.

GRAY CARDS—one point—easiest to identify, FIG. 8;

BURGUNDY CARDS—two points—easily identifiable, FIG. 9;

BLUE CARDS—three points—more difficult to identify, FIG. 10; and

Figure 11:
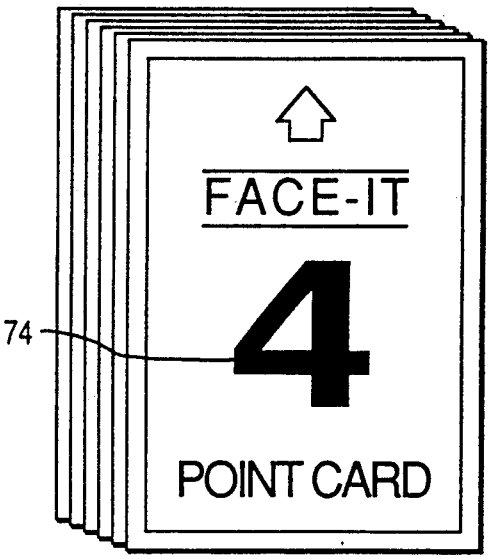
FIG. 11 is a view of a stack of four-point cards.

GOLD CARDS—four points—most difficult to identify, FIG. 11.

When a player has chosen his four cards they are placed face down without being seen by anyone, including the player choosing them. All of the players do the same until each of them has four cards face down on the playing surface. A player may choose four gold cards of FIG. 11, for example, hoping to have a chance to receive higher point values during play. Another player may choose one gray card of FIG. 8, two blues of FIG. 10, and one gold of FIG. 11, hoping that some points will be assured by having an easier card to identify. Any other combination is allowed.

The next step in preparing to play is for each player to roll the Face-Off die (FIGS. 14 and 15) again to choose a Final-Face card. The person who won the roll at the start of the game rolls first. If the die of FIGS. 14 and 15 shows a color 77, 80, 81, 82, that player picks a card of that color and looks at it without showing it to anyone else. He then takes the card and places it face down in one of the Final-Face holders of FIGS. 25 and 26. (Alternate devices are shown in FIGS. 19, 22, 27, 31, 32 and 33, for example.) Each player does this in turn until all players have a Face-It card concealed in a Final-Face holder. If a player rolls a "zero" as shown in FIG. 11 at 78 or 79, he has the option of choosing a card of any color (FIGS. 8, 9, 10, or 11) (degree of difficulty) to place in his Final-Face holder (FIGS. 25 and 26 or alternates 19, 22, 27, 31, 32 and 33), and only that player will known its color. See FIGS. 25, 26, 19, 22, 27, 31, 32 and 33 for views of possible Final-Face holders.

Figure 7:
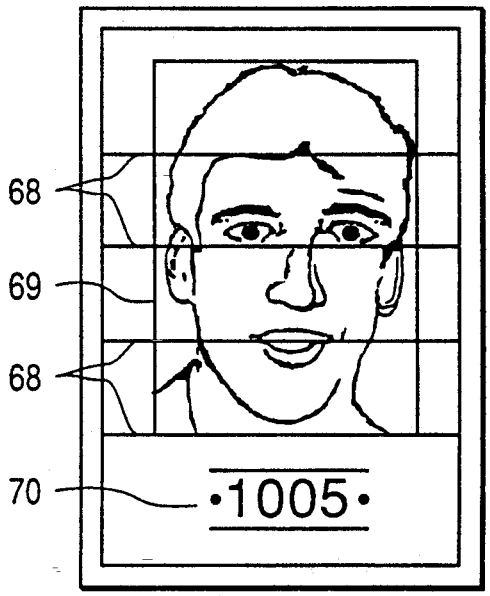
FIG. 7 is a front view of a playing card.

If a player cannot identify his "Final-Face" hidden card, he must find the correct name or title in the master list booklet of FIG. 28 by checking the reference number on the card, as shown in FIG. 7 at 70 and then locate that number and name in the master list booklet 122 and 123 in FIG. 28.

(6) Playing the Game

The game begins with the player who goes first preparing to identify his four cards (FIGS. 8, 9, 10 and 11). Another player (anyone) starts the timer of FIG. 24, when both parties are ready by pushing the button 106, and saying "go." The timer of FIG. 24 is started, and the player whose turn it is flips his four cards over and tries to identify the images on them. When the fifteen seconds shown in FIG. 24 are up, the audio buzzer 108 (FIG. 24) sounds and the player is awarded the point values corresponding to those cards (number 71 in FIG. 8, number 72 in FIG. 9, number 73 in FIG. 10 and number 74 in FIG. 11). The player keeps the cards that he correctly identifies and turns them over to reveal their point value (see FIGS. 8, 9, 10, 11). They can then be used later in the game for betting on Final-Faces (see above description of Final-Face card). The other (unidentified or misidentified) cards can be returned to an appropriate box.

For example, if a player correctly identifies three of his cards in his fifteen seconds, he places the fourth card back into its appropriate box and keeps the others for their point value. If, for example, he identified a blue card (FIG. 10) and two burgundy cards (FIG. 9), his score for that hand would be seven points. The player can then use these seven points to wager bets in the Final-Face round(s). The point value for each card is in number form on the reverse side of the card (as shown in FIG. 6 at 67), so that the card itself functions as a betting token (see diagram of card in FIGS. 6 and 8–11).

If a face has been named during play and there is question as to the answer's validity or if a face cannot be identified, there is a number, 70 in FIG. 7, on the picture side of the card which can be used as a reference for the answer in the master list booklet illustrated in FIG. 28. Reference numeral 122 designates the number on the card, numeral 123 illustrates the definition or answer and numeral 124 illustrates a brief description of the named card. Play continues with each player having a turn at identifying his four cards. When all players have completed their turns, the player with the most points for that round earns the chance to go first in the next round—the "Final-Face" round.

(7) The Final-Face Round

The player with the most points scored in the last round goes first in this round and has a new challenge. He must choose another player's Final-Face holder (FIGS. 25 and 26 or alternate devices as shown in FIGS. 19, 22, 27, 31, 32 and 33) and make a bet to see whether he can identify it. The cards in the Final-Face holders are all hidden. While there is a minimum bet of two points, there is no maximum bet limit. After the player has decided on a bet and chosen a player's card to attempt to identify, he lifts the card out of his Final-Face holder one notch 111 (FIG. 25). This allows the cover over the picture of the card to expose to one fourth (see numeral 66 in FIG. 7) of the face. The player then attempts to identify the face within his timed fifteen second period.

Figure 12:
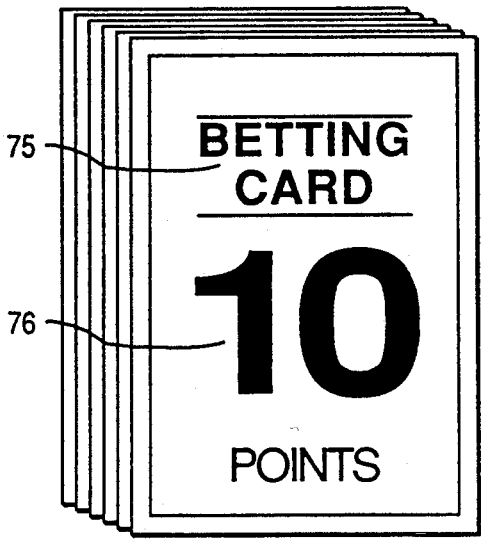
FIG. 12 is a view of a stack of ten-point betting cards.
Figure 13:
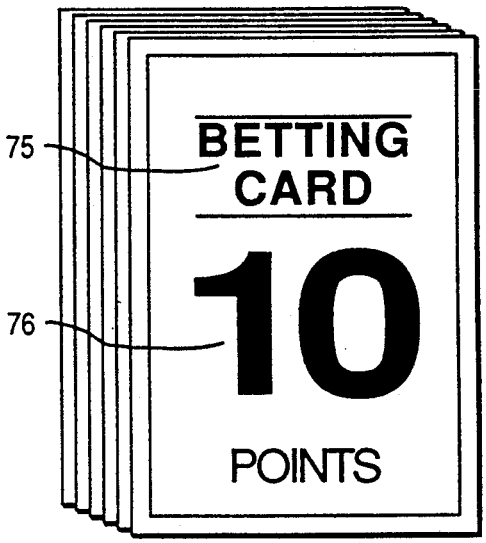
FIG. 13 is a view of a stack of twenty-point betting cards.

If the player guesses correctly he keeps the card and adds its point value to his total, takes his bet points back, and takes the matching value of the correct response and his bet, in "Betting Cards" (FIGS. 12 and 13). If he guesses incorrectly or fails to guess, he loses the card which he bet (the point value on the color side of the card). Each player does the same, with the person who scored the second highest number of points in the last round going next, and so on. The Final-Face card is more revealed (see arrow 109 in FIG. 25) as play continues, showing more of the face 110, and probably making bets go higher. The players always have the option of choosing any player's Final-Face card to bet on, except their own. When a Final-Face card has been identified and that card has gone to the player who identified it, the player whose card was identified rolls the die (FIGS. 14 and 15) again and places the resulting card in his Final-Face holder 25 and 26 (alternates 19, 22, 27, 31, 32 and 33) just like at the start of play.

(8) Continuation of Play

Play continues with alternating rounds of four cards, then Final-Face and so on, until a player or team of players reaches one hundred points. Other point totals may of course be used to lengthen or shorten the game as desired.

(9) Summary

Thus, this image recognition game includes a plurality of cards with different faces or other images on them and grouped in different categories and a revealing device. At least some of the cards are passed out face down to the players. Each player turns his cards over and within a certain time limit tries to identify the faces on them. The winner of this identification "Face-It" round goes first in the "Final-Face" round. In the latter round, cards are held in the revealing device and the device gradually or incrementally reveals the faces on the cards held therein. The players try to identify the faces as early in the revealing period as they can. The players can bet the points they accumulated in the Face-It round in the Final-Face round, tand the first player to accumulate a predetermined number of points is declared the winner. Variations on this game theme are also disclosed herein and discussed below.

Young children can play because images like horses and cows would be the objects of their challenge. For trivia whizzes the ability to recognize the upper one third of Francis Scott Key's head may (or may not) be a challenge. For the average person, George Bush may be a giveaway, while recognizing Calvin Klein may be a challenge.

As compared to most of the other games available on the market today, none have the endless categories and possibilities which the present game has. Since the material for this game is virtually limitless, this game will grow, diversity and remain educational and entertaining generally indefinitely.

B. Alternative Games of this Invention

Figure 19:
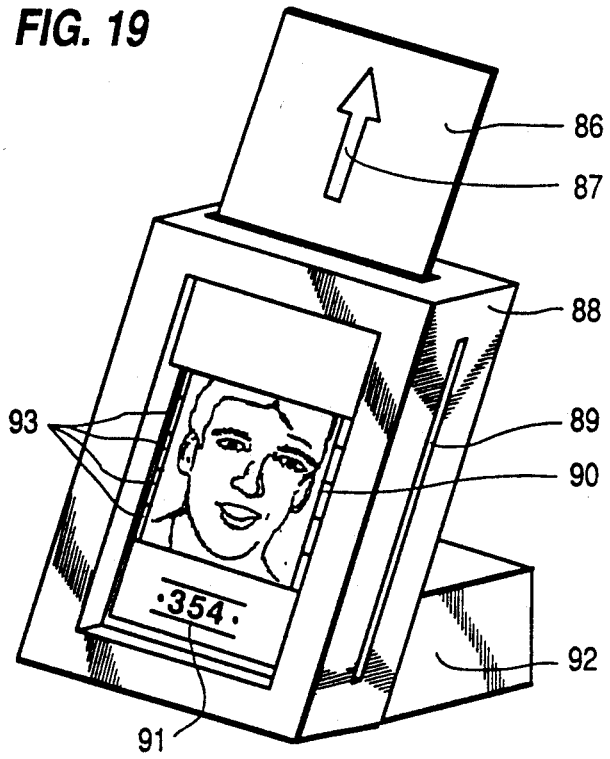
FIG. 19 is a mechanical revealing device.
Figure 22:
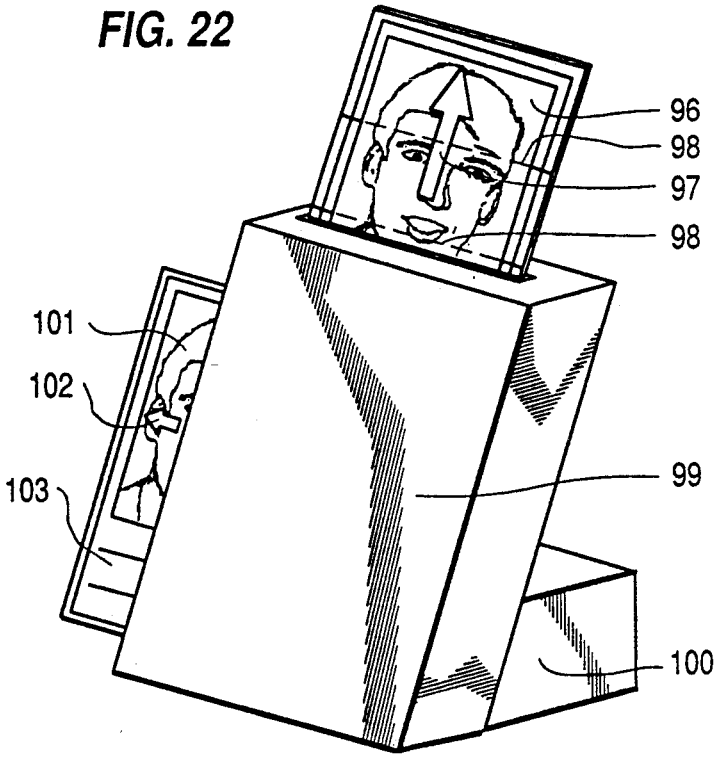
FIG. 22 is a view of another mechanical revealing device.

An image recognition game including a plurality of cards (see FIGS. 8–11) with different faces or other images on them, grouped in different categories and a revealing device (FIGS. 25, 26, 19, 22, 27, 31, or 32 and 33) is another option. At least some of the cards are passed out face down to the players. Each player turns his cards over and within a certain time limit tries to identify the faces on them. The winner of this identification "Face-It" round goes first in the "Final-Face" round. In the latter round, cards are held in the revealing device and the device gradually or incrementally reveals the faces on the cards held therein. (FIGS. 19 and 22). FIG. 19, for example, illustrates a motorized revealing device in which a motor 92 pushes a plastic panel 86 upwards and away as shown by numeral 87 from a plastic frame 88 to reveal a card 90 wherein the card would be exposed in marked increments 93. The players try to identify the faces as early in the revealing period as they can. The players can bet the points they accumulated in the Face-It round in the Final-Face round. The first player to accumulate a predetermined number of points is declared the winner.

A. One alternative uses photo images 69 in FIG. 7, but the faces would be substituted with categories listed below grouped by category, instead of point value, which provides for a different style of play. By including categories such as historical figures, politicians, sports stars, entertainers and so forth, the game can be played so that the players must recognize images or people from each of the categories, making the game educationally well-rounded. Other categories include animals, fish, plants, birds, cars, planes, boats, cartoon art, architecture, stamps, coins, characters and even chemical compound symbols.

Figure 16:
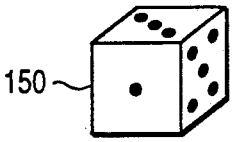
FIGS. 16 and 17 illustrate a conventional pair of dice.
Figure 17:
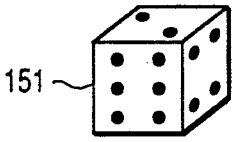
Figure 18:
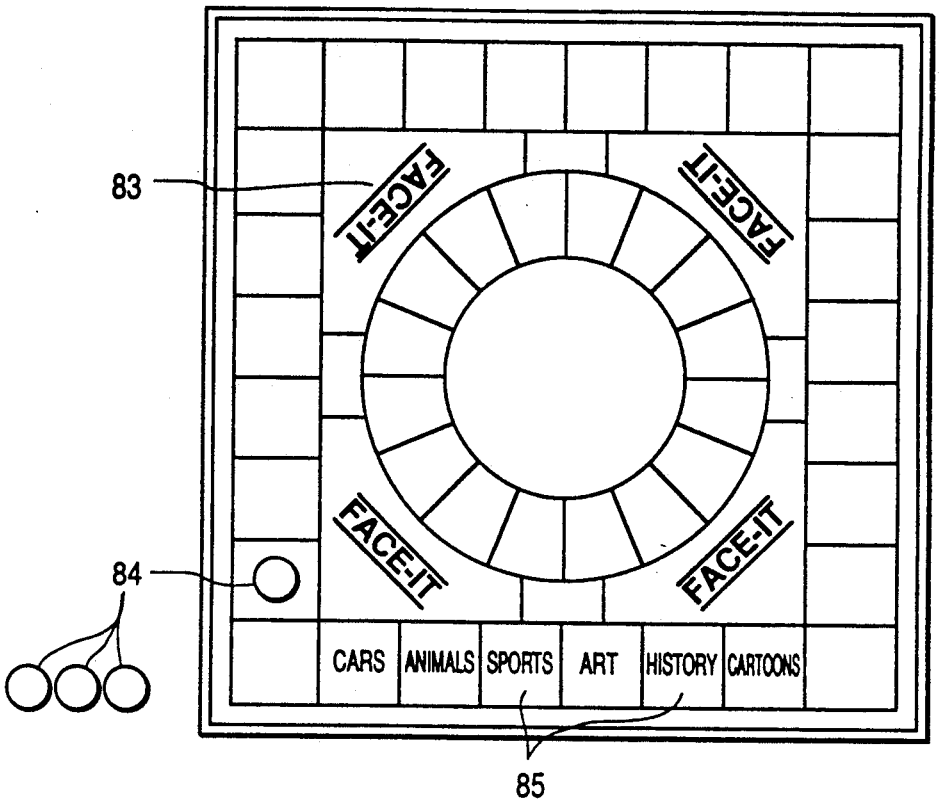
FIG. 18 is a top plan view of a gameboard for scorekeeping and game progression.

The game begins with a roll of the dice 150 and 151 as shown in FIGS. 16 and 17. Then by advancing a game token 84 in FIG. 18 or, game piece on a gameboard as shown in FIG. 18, the piece 84 lands on various categories 85, and the player then selects a card from the category landed on, play continues in a clockwise direction and movement continues across the gameboard from category to category. For each correct identification, the player receives the point value for that card 67 (FIG. 6), depending on its recognition difficulty. When a player accumulates enough points, he trades the points in for a piece to a face puzzle 131, 133–139 in FIG. 30. Pieces to the puzzle are each worth various points; for example, an eye 131 would be ten points, a nose 135 would be five points, and an ear 137 would be fifteen points. Each player would have a different colored plastic "Face Tray" 132 into which the earned pieces would fit. The object of the game is then to collect all the pieces 131, 133–139 (FIG. 30) of the puzzle and to put then in the piece holder 132 to win.

B. Another alternative provides that in order to have a chance at recognizing a face one must first answer a brief trivia question in a related category and pertaining to the card. For instance one player may ask out of a master booklet (FIG. 28) (a trivia question would be added next to name): "Who had the most starring roles in Academy Award winning movies?". The other player, whose turn it was, would have to answer that question. If he answers correctly, he looks at the face 69 of FIG. 7 and collects the corresponding points 67 of FIG. 6. If he cannot answer correctly, he can look at the card, and for fewer points try to name the face. This version also allows the players to learn facts and trivia, while still challenging their abilities to recognize faces (or other images).

Figure 23:
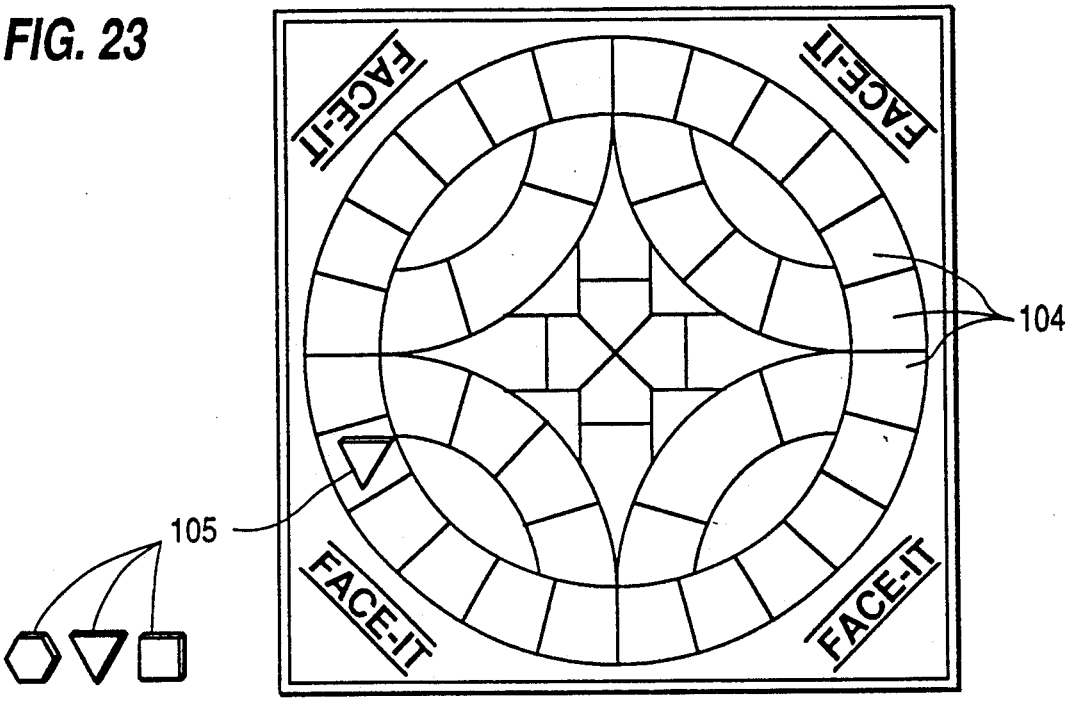
FIG. 23 is a view of an alternate gameboard for progression of play.

C. Another way to play the game has the face or image on a xerox or reproducible paper so that a sheet with an image 142 on it can be slipped into a slot 141 of a game box 140 shown in FIG. 31 with windows 143 and by pulling the plastic panel 144, a portion of the face is exposed. A player would roll the dice and move a game piece 105 across a gameboard (as shown in FIG. 23). One space on the gameboard 104 may say "Identify a sports star". The player would then insert an image 142 into the game box revealing device 140 (FIG. 31) and attempt to identify the image. If he does not correctly identify it, play moves on to the next player. The first player to correctly identify a predetermined number of faces wins.

Figure 29:
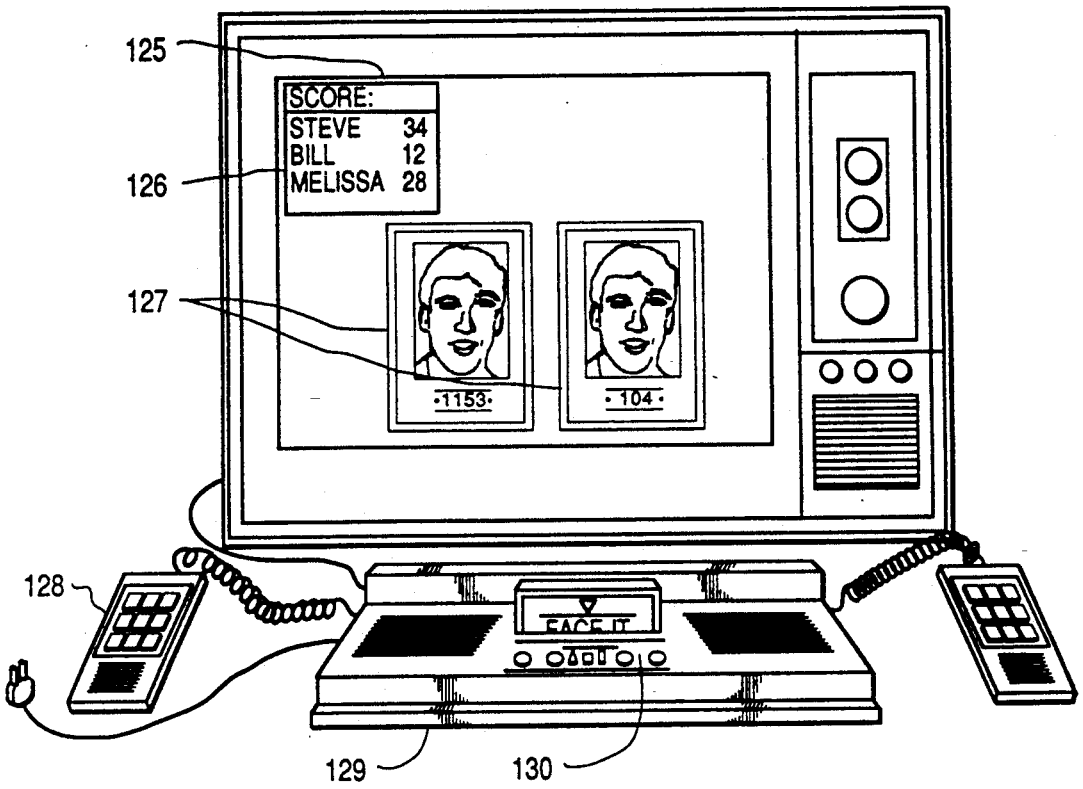
FIG. 29 is a view of a video cassette version of the present invention.

D. A further embodiment of this invention is a VCR video version, as shown in FIG. 29, wherein the players play by a remote control 128 on their television set 125. The game plays so that faces or images appear on the screen 127, but covered with a layer of "static". A video cassette 130 would be inserted into a computer game system, such as a "Nintendo" type of system. The program stores images and allows them to come up on the screen by remote control 128. The rules can be the same as the original set of rules, but instead of using cards and a board, the screen comprises the playing surface. There is a small inset on the screen for a scoreboard 126, and by simply pressing a remote control button on remote control 128 players enter their names and keep score. The Final-Face round can also be played on the screen with just a portion of a face 127 (or image) being shown at a time, allowing all players to play instead of just one player looking at a Final-Face holder, as in the original game. Just as in the original version, this version can also use animals, birds, cars, and so forth as alternate categories for play. Aside from the original rules, there are a number of other possible ways to learn from and to enjoy playing this game.

E. In another version of the game, the gameboard (FIG. 23) has various categories and game instructions 104 on it. The categories and instructions form a pathway around the gameboard, so that by rolling dice of FIGS. 16 and 17 a player can choose a direction and land on a specific category or task. Each player proceeds in order to take his turn following the gameboard instructions, until each has answered or identified a face or image from each of a given number of categories, which can vary from game to game. The players are then eligible for a betting round, where only the revealing devices (see FIGS. 25, 26, 19, 22 or 27, 31 or 32 and 33) would be used to make identification more challenging. Game continues until each player accumulates an entire face of pieces (see FIG. 30). Face pieces 131, 133–139 are awarded upon accumulating a certain number of points.

F. A television game show variation of this invention can use any of the methods of play previously described. It however uses the television screen to hold the faces or images and has a revealing device that works electronically as opposed to manually or mechanically. Actually, parts of images or faces can be brought up onto the screen one at a time or can be jumbled, and by taking turns, players attempt to identify what they saw. The method of play can be any of those listed herein.

G. Another game of this invention uses a revealing device electronically powered (see FIGS. 19 or 22) so that the image or face slowly and gradually becomes exposed. Play proceeds so that more points are awarded for the quicker one could identify the face or image. For instance and referring to FIG. 22, five points can be awarded for being able to identify the top quarter of the image 96, and as the image 98 moves (see arrows 97 and 102) and becomes more visible, for example, one-half or three-quarters of the image, fewer points are awarded. The movement of the card can be in two directions. The core play of this game can play like alternatives A–F hereabove or the preferred embodiment, but the moving image would be introduced.

H. Another alternative discloses, in the event a card is not correctly identified, a choice of three names, only one of which is correct, and is used to give the player a clue. Of course, fewer points are awarded for correct identification after disclosure, but this adds another dimension to the present game invention.

Figure 34:
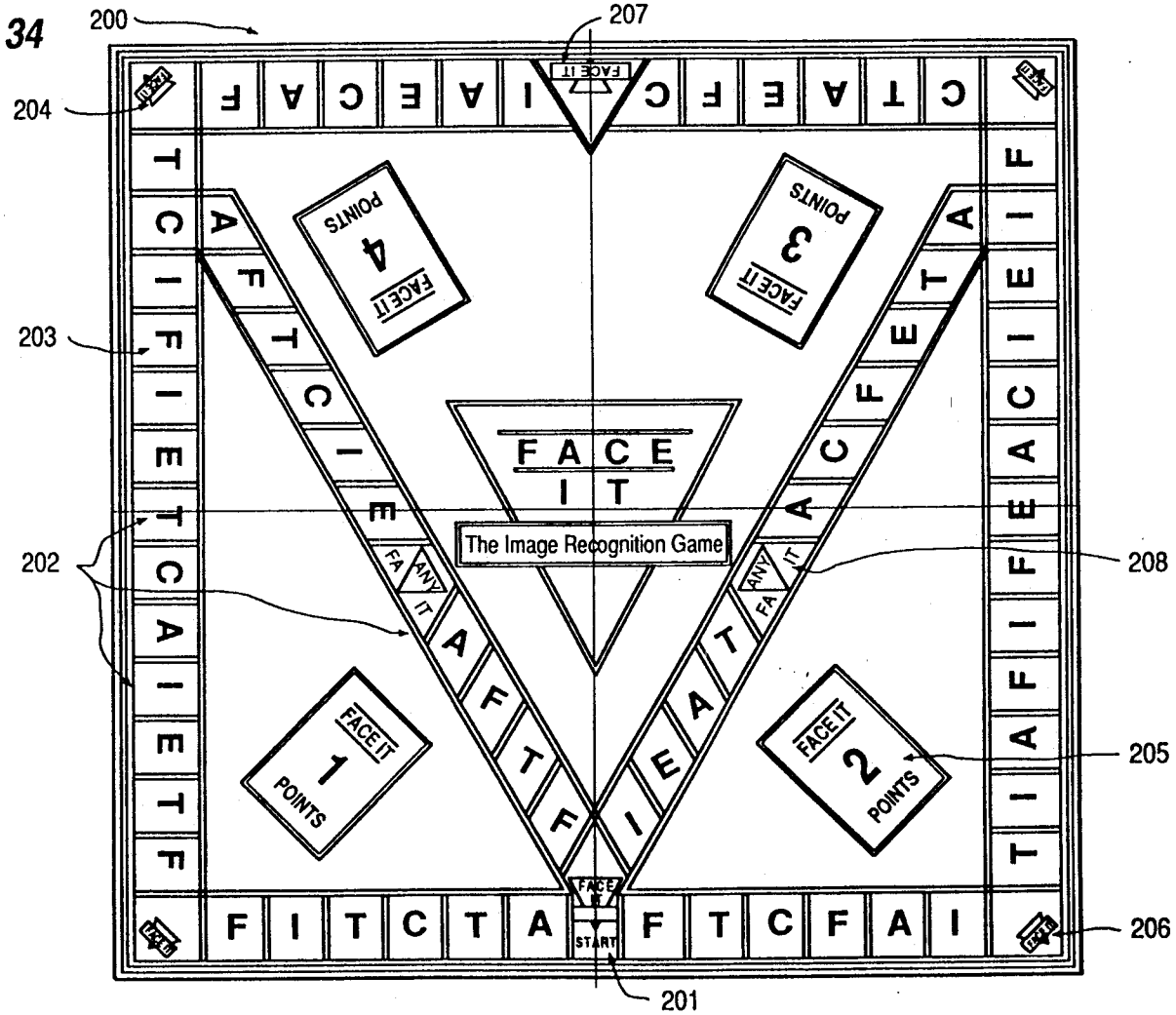
FIG. 34 is a top plan view of an alternative preferred gameboard of the invention.

I. Another embodiment of the present invention uses a gameboard 200 similar to but slightly different than those illustrated in FIGS. 13 and 23. This gameboard, which is illustrated in FIG. 34, has a starting location 201 and a number of different paths 202 emanating from the starting location. Each path 202 is comprised of a series of spaces or steps 203 and indicia, directions or instructions 204 associated with many of the spaces or steps. These indicia 204 provide directions to the player, whose game piece (FIG. 46) lands on the associated step 203, as to what is to be done. In particular, the step 203 can direct the player to one or more specific revealing devices, such as have been previously described or as is shown in FIGS. 37 through 44 generally at 215 and described in detail below. It further can direct him to operate the revealing device 215 in a specific manner. For example, it can direct him to open one or more specific windows or shutters 216 or 217 in one of the revealing devices 215 thereby increasing his chances of recognizing the previously hidden image 222 on the card 223.

Figure 30:
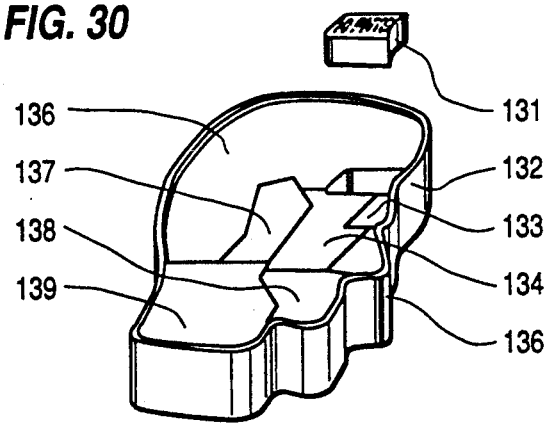
FIG. 30 is a perspective view of a face puzzle for scorekeeping.
Figure 31:
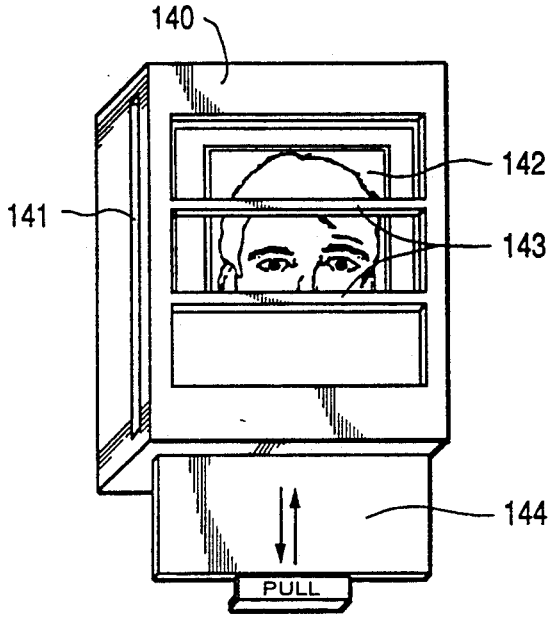
FIG. 31 is a view of an alternate revealing device.
Figure 32:
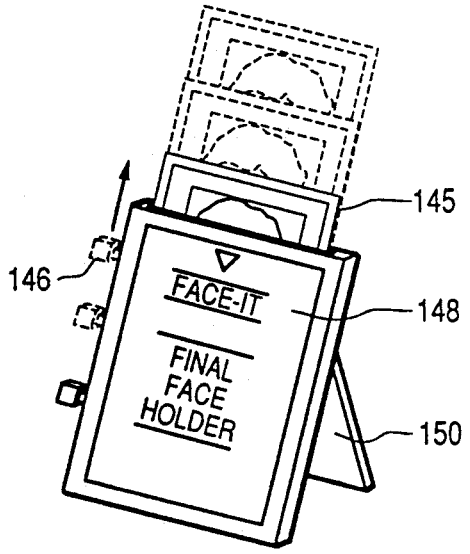
FIG. 32 is a perspective view of a revealing device.
Figure 33:
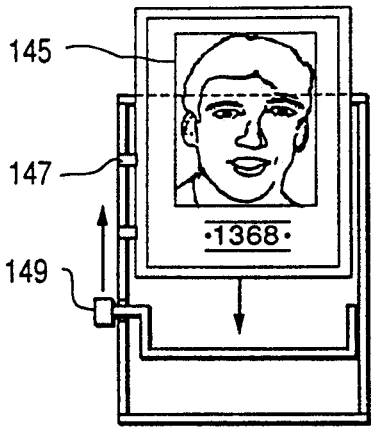
FIG. 33 is a section through the revealing device of FIG. 32.
Figure 36:
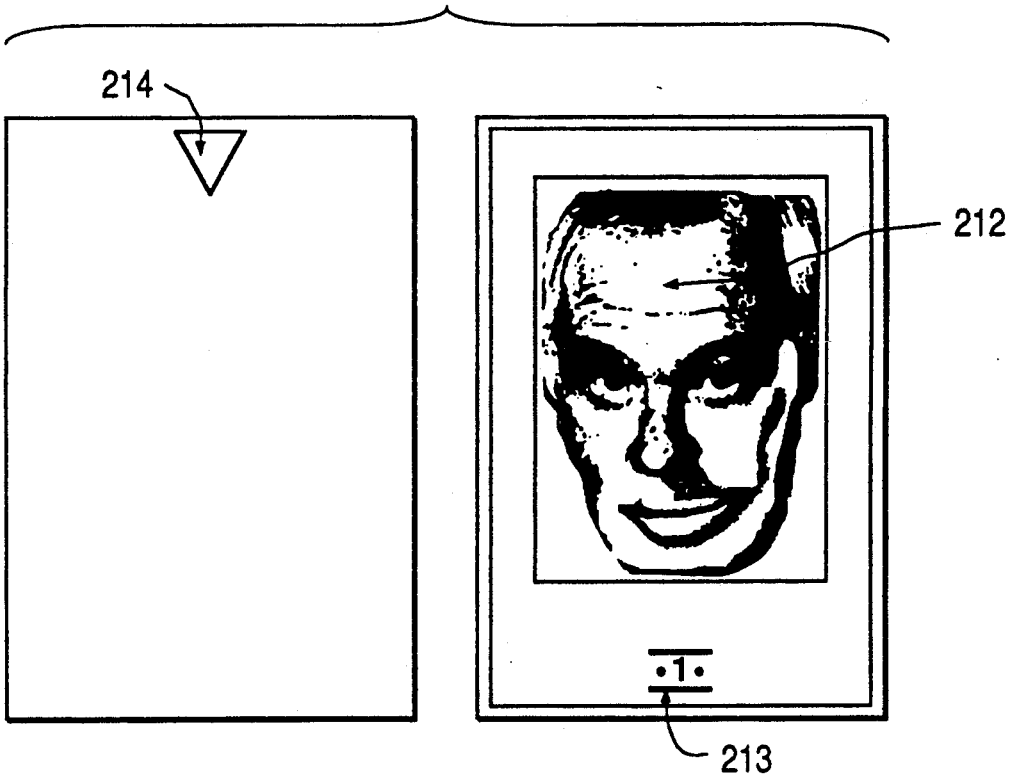
FIG. 36 are front and back views of a picture (face photograph) card of this invention.
Figure 46:
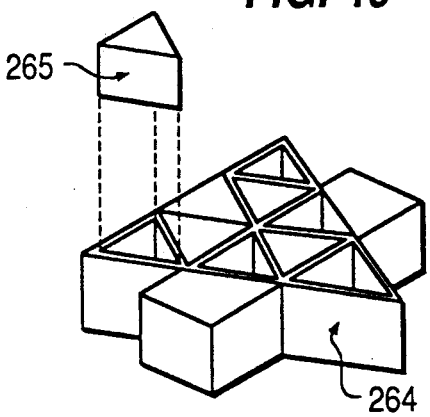
FIG. 46 is a perspective view of a scorekeeping puzzle of the apparatus of FIG. 35.

Greater numbers of points may be accorded to a player depending upon which revealing device 215 and hence which disclosed image 222 he identifies. The accrued points can be used to purchase pieces of a puzzle as shown in FIGS. 30 and 46. As shown in FIG. 34, the gameboard 200 can include central spaces 205 for positioning of (four) revealing devices 215. Each will hold a card (FIG. 36) with a unique image 212 on the card. These images may be people's faces and animals or other symbols, or they can be in the same general category but of different levels of difficulty.

J. An alternative and preferred revealing device is depicted in FIGS. 37 through 44 at 215. This device formed of polystyrene plastic and made by an injection molding construction technique includes a top plate (or top bezel) shown as 229 in FIG. 39 and in more detail in FIG. 40 (top view 238, front end view 239, rear end view 241, and side view 240); a bottom plate (bottom bezel) shown as 231 in FIG. 39 and in more detail in FIG. 41 (top view 242, front end view 243, rear end view 245, and side view 244); a clear window shown as 230 in FIG. 39 and in more detail in FIG. 42 (top view 246, front end view 247, and side view 248); six identical opaque sliding windows or shutters shown as 216 and 217 in FIG. 37 and 232 in FIG. 39 and in more detail in FIG. 43 (top view 249, end view 250 and side view 251); and a rear window or rear shutter shown as 233 in FIG. 39 and in more detail in FIG. 44 (top view 252, end view 253 and side view 254).

Figure 39:
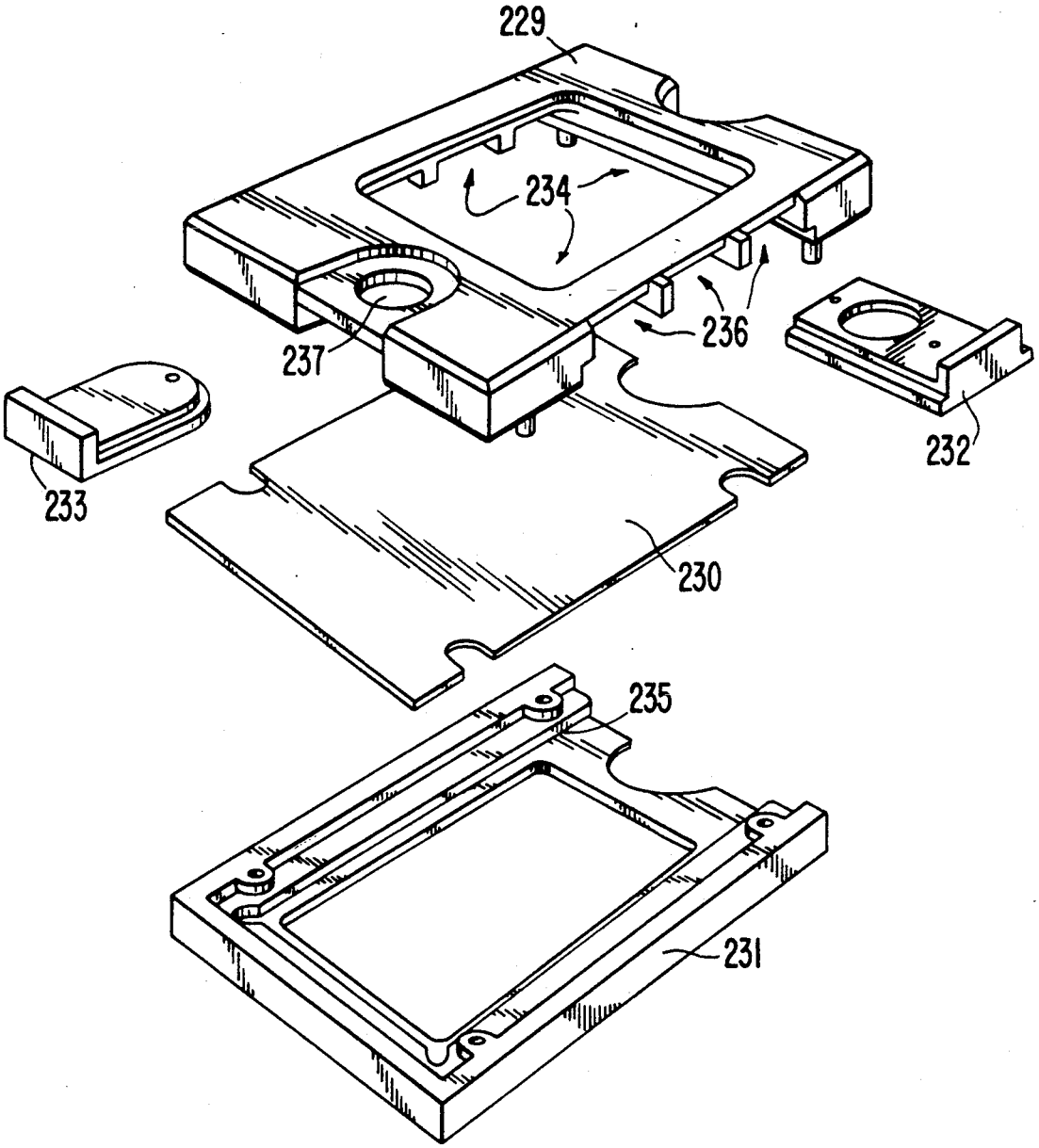
FIG. 39 is an exploded perspective of the device of FIG. 37.
Figure 40D:
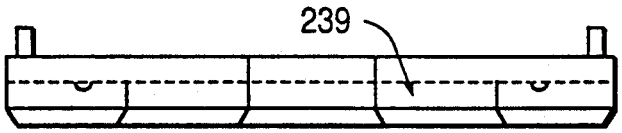
FIGS. 40*a*, 40*b*, 40*c* and 40*d* are plan, front, side and rear views, respectively, of the top plate of the device of FIGS. 37 and 39.
Figure 40A:
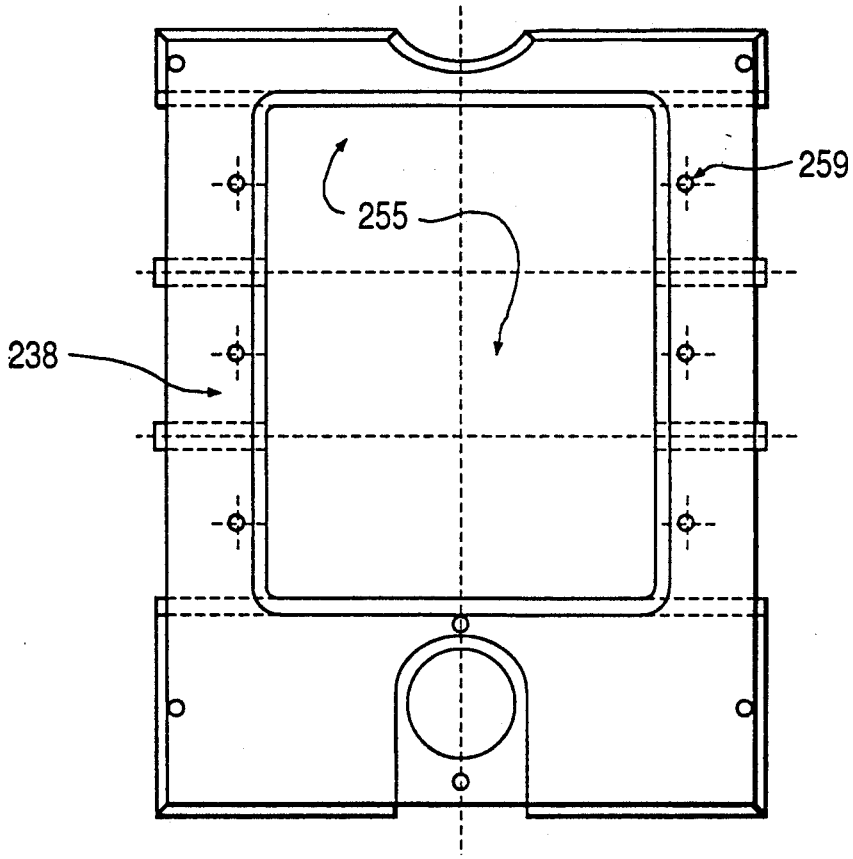
Figure 40C:
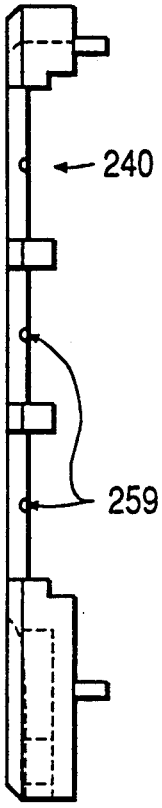
Figure 40B:
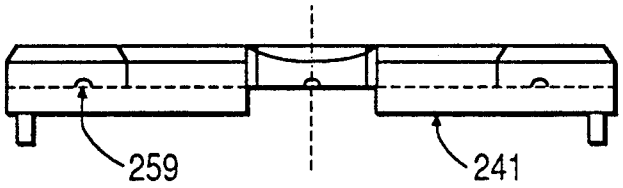
Figure 41D:
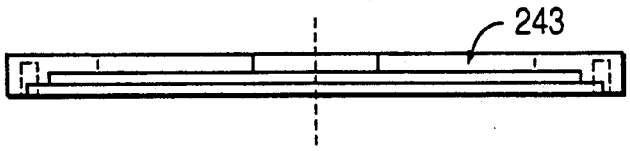
FIGS. 41*a*, 41*b*, 41*c* and 41*d* are plan, front, side and rear views, respectively, of the bottom plate of the device of FIGS. 37 and 39.
Figure 41A:
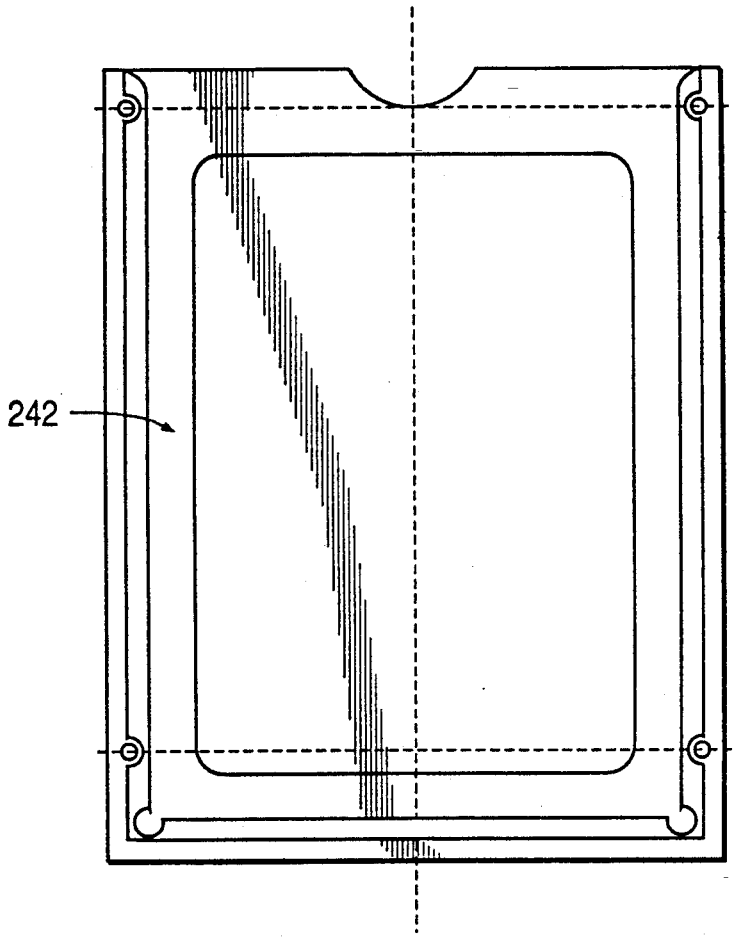
Figure 41C:
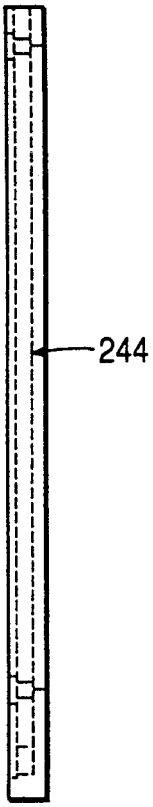
Figure 41B:
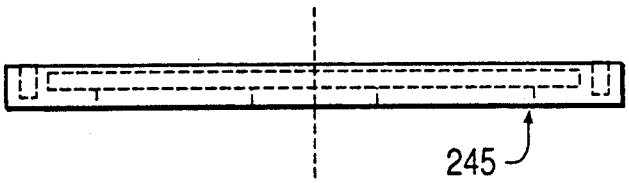
Figure 42C:
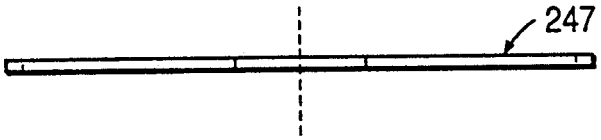
FIGS. 42*a*, 42*b* and 42*c* and plan, side and end views, respectively, of the window of the device of FIGS. 37 and 39.
Figure 42A:
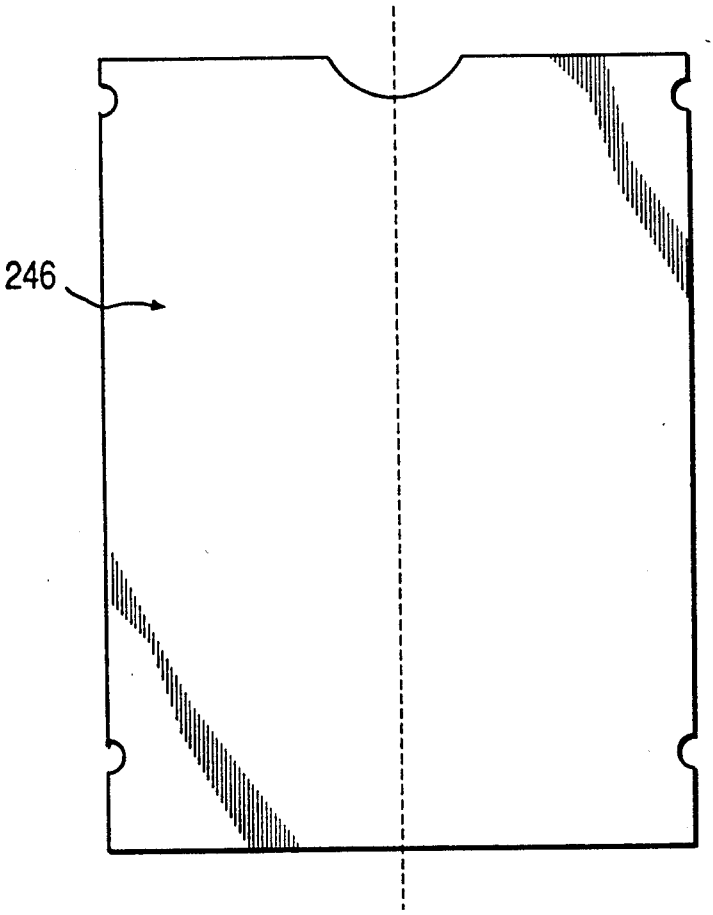
Figure 42B:
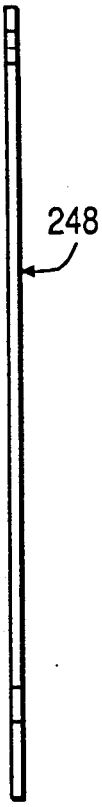
Figure 43A:
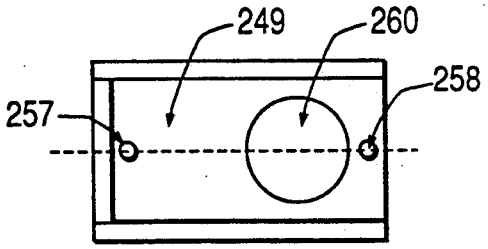
FIGS. 43*a*, 43*b* and 43*c* are plan, side and end views, respectively, of one of the windows or shutters of the device of FIGS. 37 and 39.
Figure 43C:
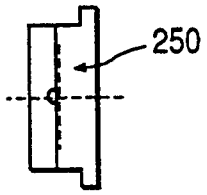
Figure 43B:
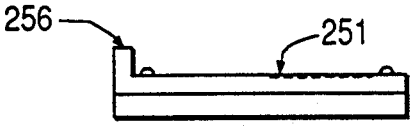

The top plate has a rectangular through opening 234 in FIG. 39, and 255 in FIG. 40. A thin slot 225 in FIG. 38 extends substantially the entire length of the device below a clear window (FIG. 42) as 226 in FIG. 38 and 235 in FIG. 39. It is open at the top 228 (FIG. 38) in order to allow a game card 224 (FIG. 36) to be easily inserted into it, and closed at the bottom 227 (FIG. 38) to hold the card in place. When in the inserted position the image portion 212 of the card 224 is centered and communicates with the through opening 234 in the top plate as shown generally in FIG. 37 and also in FIG. 39.

The windows or shutters 216 and 217 (FIGS. 37 and 43) are disposed in slots on the sides of the device 236 (FIG. 39). Three windows slide inwardly from the left and three from the right (FIG. 37), such that when the windows are all in a closed position 217 (FIG. 37), the entire through opening 234 (FIG. 39) and 255 (FIG. 40) is closed and the image 222 (FIG. 37) on card (FIG. 36) inserted in the device 223 (FIG. 37) is completely covered. Each of the windows has an upstanding end tab 256 (FIG. 43) to aid in grasping and moving the windows to their open positions by manually sliding it longitudinally as shown at 218 in FIG. 37. A snap-tab is provided on each window in two-locations 257 and 258 in FIG. 43 in order to "lock" the windows in their open or closed positions. The tab pops into a recess under top plate FIG. 40 as shown at 259.

Figure 44A:
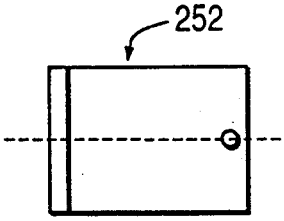
FIGS. 44*a*, 44*b* and 44*c* are plan, side and end views, respectively, of the rear window or shutter of the device of FIGS. 37 and 39.
Figure 44C:
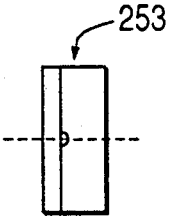
Figure 44B:
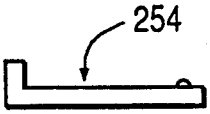

Each of the windows 216 and 217 (FIG. 37) has its own identifier, shown generally at 219 (FIG. 37), associated with it such that the window(s) to be opened at any time during the play of the game can be quickly identified. This identifier 219 is associated with the positioning of a game piece FIG. 46 on the gameboard 200. One identification system includes a circular area 260 (FIG. 43) on top of the window with a letter or other identifier 219 (FIG. 37) therein. At the bottom of the revealing device is a circular opening 220 (FIG. 37), which when opened communicates with a reference number 221 (FIG. 37) and 213 (FIG. 36) on the game card. This circular opening 221 (FIG. 37) and 237 (FIG. 39) is opened by a slide 233 (FIG. 39 and FIG. 44). The number 213 on the game card corresponds with the same number in a masterlist booklet 261 (FIG. 45), wherein the image can be identified.

C. A Preferred Embodiment in Game Instruction Format (1) Object of the game

To be the first player to score thirty points.

(2) Players

Two or more players, or teams of players.

(3) Equipment

Figure 35:
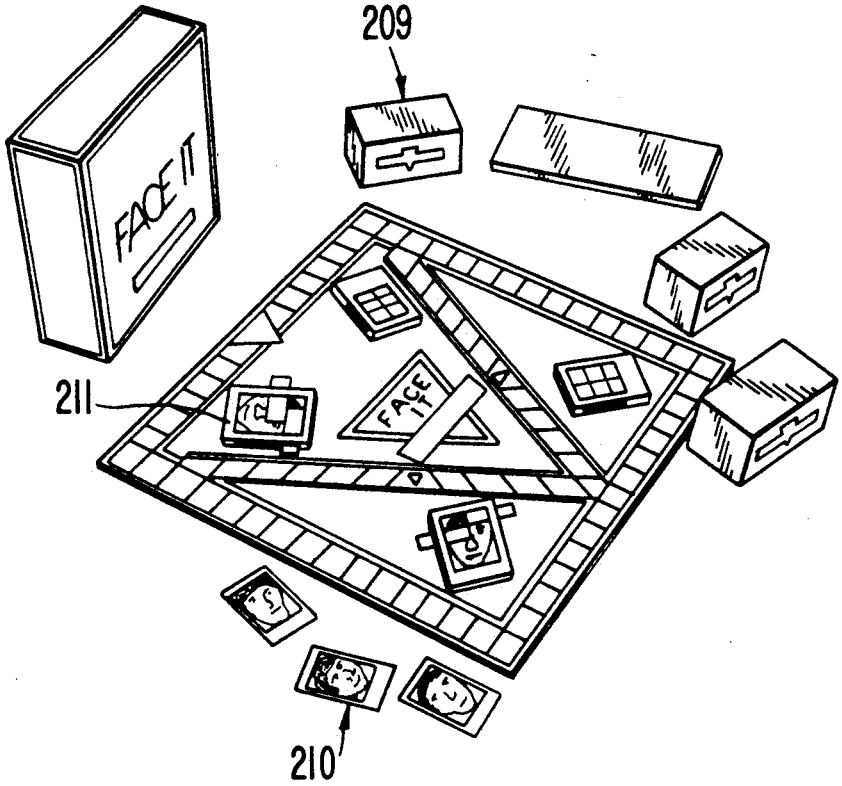
FIG. 35 is a perspective view of a game apparatus of this invention including the gameboard of FIG. 34.

Four face card boxes 209 (FIG. 35), two thousand "Face-It" playing cards 210, one pair of dice (FIGS. 14–17), one masterlist booklet 261, four revealing devices (one gray, one burgundy, one blue and one gold) 215 (FIGS. 35 and 37), a score pad 94 and pencil 95, eight differently colored or shaped game tokens or playing pieces (FIG. 46) and a gameboard 200 (FIG. 34).

(4) Getting ready to "Face-It"

Each player begins by rolling the dice to determine who goes first. The highest roll starts and play continues in a clockwise direction. Any player then inserts an appropriate card (FIG. 36) into each of the four revealing devices 215 without looking at the image or face 212 on the card. An easy method of inserting a card (FIG. 36) in the slot 225 without seeing the face 212 on it is to flip the device over and insert the card face down, so that the white triangle 214 (FIG. 36) shows at the top of the device. All of the windows or shutters 216 and 217 are and have been closed so that no part of the face 212 can be seen. Each device 215 is then positioned face up on the matching colored square 205 (FIG. 34) and 211 (FIG. 35) located on the gameboard 200. Each player selects a different game playing piece (FIG. 46) and places it on the space marked "start" 201 on the gameboard 200.

(5) Playing the game

The game begins with the first player rolling the dice and moving his token along a path on the gameboard 200 to the space or step as directed by the dice roll. Movement can be in any desired direction on the gameboard 200 from the start 201 except in a backwards direction. When a player lands on a space marked with a letter and a color 203, he is thereby instructed to open the corresponding window 216 and 217 on the corresponding device 215 of that color. For instance, if he lands on a gray space marked "F," he opens the window 216 marked "F" on the gray face holder revealing device 215.

When a player lands on a colored space marked with a number and the "Face It" symbol (that is, any of the four corner spaces) 206 (FIG. 34), all of the windows 216 and 217 of the face holder revealing device 215 of the corresponding color are opened. For instance, if he lands on the blue corner space marked "Face It-3", he opens all of the windows on the blue (three-point) device. When he lands on "start" 201 or any other space with the "Face It" symbol 207, he opens all of the windows on any single revealing device of his choice. When he lands on a space marked "any F, A, I, T," 208, he can open the F, A, I and T windows of any revealing device of his choice.

(6) Attempting an identification

Each player upon opening a window or windows 216 and 217 on a revealing device 215 may attempt to identify the face card 222 and 223 (FIG. 37) within it within a reasonable amount of time, such as ten seconds.

When attempting to identify a face 212 on a face card, the player must say it out loud and state the full name of the face on that card. For example, he must say "Tom Selleck," not "Magnum" or "that Selleck guy." The other players determine whether this guess was accurate. If they all agree that the identification is correct, the remaining windows 216 and 217 of that device 215 are opened to reveal the face 222. The corresponding points are then awarded for the correct identification. In other words and for example, one point is awarded for cards in the gray device, two for cards in the burgundy device, three for those in the blue device, and four for those in the gold device.

If any other player is unsure about the identification made, the player who is guessing opens the window 233 (FIG. 39) to reveal the face card identification number 221 (FIG. 37), which is located on the card below the face. He then matches that number with the number in the masterlist booklet 261 (FIG. 45) and reads across to the correct name 262. If he was correct, the face card 223 is removed from the device 215 and placed at the back of the card box 209 (FIG. 35) and the point value is awarded to him. The masterlist booklet 261 also includes a column 263 for "occupation" which is provided so that players can learn more abut the image and associate the image with a brief description.

On the other hand, when a player checks the booklet 261 and learns that his identification was incorrect, the corresponding point value is subtracted from his score. (The score can be kept on a score pad 94 and with pencil 95.) The windows 216 and 217 on the device 215 are then closed and the revealing device remains as it was before. The player who guessed incorrectly can no longer, of course, play on that face holder device until another player has correctly identified and replaced the card. For instance, if a player attempted to identify a card in the gray holder device and the "F" and "T" windows were open, and that player checked and learned that he guessed incorrectly, those two windows would remain open and that player may no longer open any windows on the gray face holder until a new card has later been placed in the gray face holder.

During a turn, a player or team can attempt identifications for any or all of the cards in play and the procedure is the same as previously stated for each identification attempt.

(7) Continuation of play

Play continues in turn, clockwise. Players who correctly identify face cards place the cards in the back of the card box (see FIGS. 1-5) and 209 in FIG. 35 and insert a new card into the empty device 215 without anyone seeing the image on it. If all of the face windows of any holder 215 have been opened, and each player has had a chance to identify the card but no player did so successfully, the player who last tried checks to determine whether anyone wants to guess. If no one wants to, he removes the card, looks up the correct name in the masterlist booklet 261 and reads it out loud so that the other players learn the name.

When doubles are rolled the player is given a second turn and can roll the dice again. The game is completed when a player or team has collected thirty (or any other previously selected point total) points.

Figure 37:
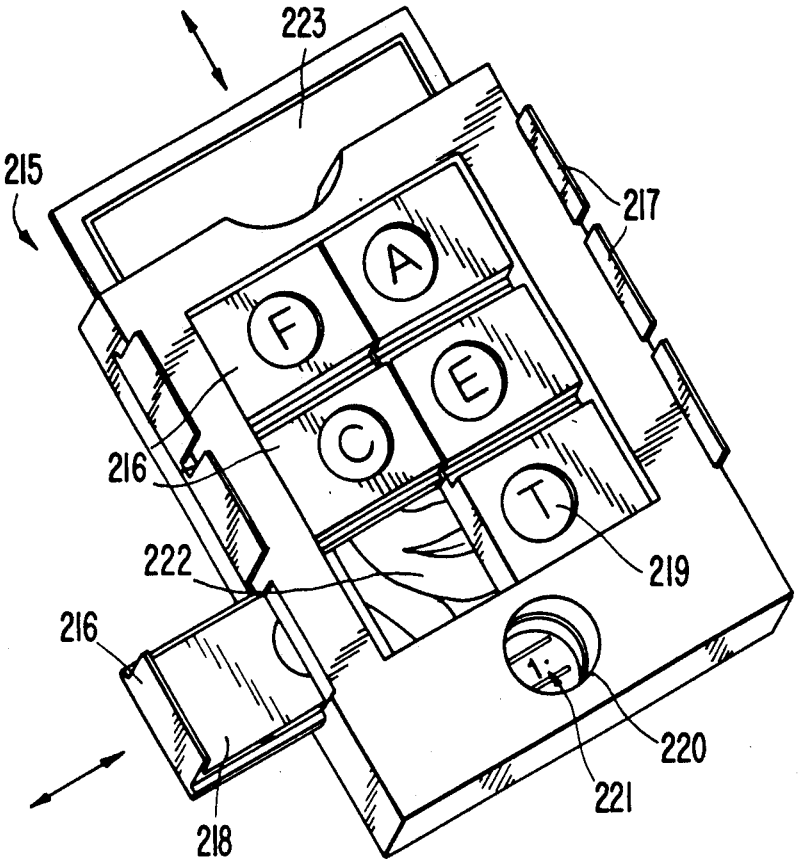
FIG. 37 is a top perspective of an alternative revealing device, with the picture card of FIG. 36 shown inserted therein and with one shutter thereof in an open position, of the game apparatus of FIG. 35.
Figure 38:
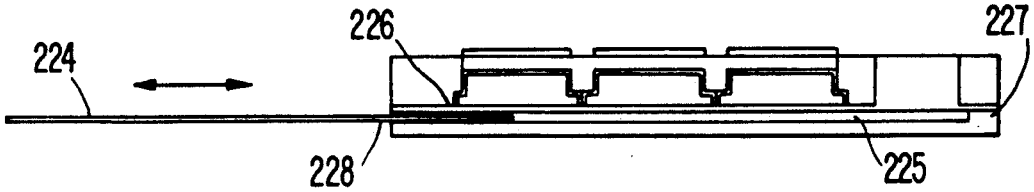
FIG. 38 is a cross-sectional view of the device of FIG. 37.

The portion of the face which typically provides quickest identification is the eyes and the surrounding area, which is approximately the middle third of the face. This is represented by the "C" and "E" windows or slide shutters 216 and 217 of the device as seen in FIG. 37. To make identification more difficult, the frequency with which the middle two shutters (the "C" and "E" shutters) are opened has been reduced as compared to the top two shutters (the "F" and "A" shutters) and the bottom two shutters (the "I" and "I" shutters). Alternatively, the middle shutters can be opened on the average later than the top and bottom shutters during an image identification sequence. This relative opening has been adjusted by altering the steps 203 on the gameboard 200 by altering the relative number or locations of the steps, that is, proportionately fewer C and E steps will be encountered. If identification is to be made easier or quicker, a converse altered design can be used.

Other alternatives of this game are possible and would be appreciated by those skilled in the art from this disclosure. One alternative is that, instead of points, pieces to a puzzle such as that shown in FIG. 30 or 265 in FIG. 46 are awarded. The player who first completes the puzzle wins. Another alternative would be that each device corresponds to a differently sized wedge of a pie and when a player correctly guesses the face in that device he is awarded a puzzle piece of that pie-shaped wedge. He then seeks to precisely and completely fill up his circular-shaped puzzle (not shown). In other words, it may be that the only size shaped puzzle piece wedge that would complete his puzzle is the smallest gray piece in which case he cannot win the game by simply collecting wedges associated with the other devices.

From the foregoing detailed description, it will be evident that there are a number of changes, adaptations and modifications of the present invention which come within the province of those skilled in the art. However, it is intended that all such variations not departing from the spirit of the invention be considered as within the scope thereof as limited solely by the claims appended hereto.

What is claimed is:

1. An image recognition game apparatus, comprising:

a gameboard having a plurality of areas defining at least one gamepath;

a first gamepiece for a first player and movable along said at least one gamepath;

a second gamepiece for a second player and movable along said at least one gamepath;

a first card having a first image thereon;

a second card having thereon a second image, different from said from image;

a first revealing device including a first holder having a first viewing area, and a plurality of first shutters, said first viewing area being positioned such that with said first card in an insert position in said first holder said first image is at least substantially in said first viewing area, each said first shutter being movable between open and closed positions relative to said first viewing area such that when in the open position a corresponding portion of said first image of said first card in the insert position is visible through said first viewing area and when in the closed position the corresponding portion is blocked from viewing by the first and second players; and a second revealing device including a second holder having a second viewing area and a plurality of second shutters, said second viewing area being positioned such that with said second card in an insert position in said second holder said second image is at least substantially in said second viewing area, each said second shutter being movable between open and closed positions relative to said second viewing area such that when in the open position a corresponding portion of said second image of said second card in the insert position is visible through said second viewing area and when in the closed position the corresponding portion is blocked from viewing by the first and second players;

wherein the movement of said first and second gamepieces along said at least one gamepath determines whether each of said first and second shutters is moved from their closed positions to their open positions to thereby expose to a greater extent at least one of said first and second images for attempted recognition by at least one of the players.

2. The apparatus of claim 1 further comprising a third card having a third image thereon and insertable in an insert position in said first holder with said third image at said first viewing area.

3. The apparatus of claim 2 wherein said first and third images are more difficult to recognize than said second image.

4. The apparatus of claim 1 further comprising a master list separate from said first and second revealing devices and indicating therein the identity of said first and second images.

5. The apparatus of claim 4 wherein said first card includes an indicia thereon and said master list includes the identity of said first image, which identity is therein associated with said indicia.

6. The apparatus of claim 5 wherein said first holder includes a window through which said indicia can be viewed with said first card in the insert position.

7. The apparatus of claim 6 wherein said first revealing device includes a shutter for covering said window.

8. The apparatus of claim 1 wherein some of said first shutters open in a direction opposite to that of other of said first shutters and relative to said first holder.

9. The apparatus of claim 1 further comprising timing means for setting the time available for a player during his turn to attempt an identification of at least one of said images.

10. The apparatus of claim 1 wherein at least one of said gameboard areas has thereon indicia indicating which of said shutters of which of said revealing devices is or are to be moved from the closed to the open positions by the player whose said gamepiece landed on said area having said indicia.

11. The apparatus of claim 1 wherein said first revealing device includes said first holder having a first slot in through which said first card is inserted to the insert position.

12. The apparatus of claim 1 wherein said first shutters are configured such that when all said first shutters are in the open positions said first image, with said first card in the insert position, is fully revealed through said first viewing area.

13. The apparatus of claim 1 further comprising chance means for determining movement of said first and second gamepieces along said at least one gamepath.

14. The apparatus of claim 1 wherein the movement of said first gamepiece on said at least one gamepath directs the movement of at least some of both said first and second shutters to their open positions.

15. The apparatus of claim 1 further comprising said first card including a first marking thereon corresponding to said first image, and a master list generally separate from said first revealing device and including therein said first marking and associated therewith the identity of said first image.

16. The apparatus of claim 15 wherein said second card includes a second marking thereon and said master list includes therein said second marking and associated therewith the identity of said second image.

17. The apparatus of claim 1 wherein said first revealing device includes locking means for locking each said first shutter in the closed and open positions when positioned therein.

18. The apparatus of claim 1 wherein said first image is a photograph of a first famous person and said second image is a photograph of a second famous person.

19. A game playing method, comprising the steps of:

moving a gamepiece along at least one gamepath comprising a plurality of spaces;

providing a first revealing device having a plurality of closed first shutters, each blocking from view a different portion of a first image;

providing a second revealing device having a plurality of closed second shutters, each blocking from view a different portion of a second image;

opening at least some of the first and second shutters when the gamepiece lands on certain of the spaces and as thereby directed, and thereby exposing portions of the first and second images; and thereafter, attempting to identify the first image from the exposed portions thereof.

* * * * *